US010399138B2

(12) United States Patent
Rischen et al.

(10) Patent No.: US 10,399,138 B2
(45) Date of Patent: Sep. 3, 2019

(54) PRESSING TOOL WITH SWITCHBLADE BISTABLE TENSIONING MECHANISM

(71) Applicant: Viega Technology GmbH & Co. KG, Attendorn (DE)

(72) Inventors: Christian Rischen, Eslohe (DE); Frank Hofmann, Attendorn (DE); Stefan Leymann, Attendorn (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 737 days.

(21) Appl. No.: 14/844,634

(22) Filed: Sep. 3, 2015

(65) Prior Publication Data

US 2016/0067761 A1 Mar. 10, 2016

(30) Foreign Application Priority Data

Sep. 8, 2014 (DE) ..... 10 2014 112 869

(51) Int. Cl.
*B21D 39/04* (2006.01)
*B25B 27/10* (2006.01)

(52) U.S. Cl.
CPC ..... *B21D 39/046* (2013.01); *B21D 39/048* (2013.01); *B25B 27/10* (2013.01); *Y10T 29/5367* (2015.01)

(58) Field of Classification Search
CPC ..... B25B 27/10; B25B 7/14; B25B 7/123; B21D 39/04; B21D 39/048; B21D 39/046; Y10T 29/5367
USPC ..... 72/453.16, 409.01, 416; 29/237, 559; 132/277; 118/500; 24/295, 293; 248/316.7; 269/254 R; 81/318–324
See application file for complete search history.

(56) References Cited

U.S. PATENT DOCUMENTS 2,979,032 A * 4/1961 Engquist ..... B26B 17/02 269/25
4,426,869 A * 1/1984 Farmer ..... B21H 3/048 294/116
6,044,686 A * 4/2000 Dischler ..... B21D 39/04 29/237

(Continued)

FOREIGN PATENT DOCUMENTS

DE 29703053 U1 4/1997
DE 102007061164 A1 6/2009

(Continued)

*Primary Examiner* — Monica S Carter
*Assistant Examiner* — Mahdi H Nejad
(74) *Attorney, Agent, or Firm* — The Webb Law Firm

(57) ABSTRACT

A pressing tool for joining a pipe and a fitting, including two swivel elements for pressing the pipe and the fitting, a receiving region, formed between the swivel elements, for receiving the pipe and the fitting, at least one swivel axis for rotatably mounting the swivel elements, and a tensioning mechanism for pretensioning the pressing tool. The swivel elements can be swivelled towards one another about the at least one swivel axis to press the pipe and the fitting. In a first, closed position, the receiving region is narrower than in a second, open position, of the swivel elements, wherein the swivel elements are pretensioned towards the closed position by the tensioning mechanism. At least one holding device is provided for holding the swivel elements in the open position against the pretensioning force generated by the tensioning mechanism.

12 Claims, 17 Drawing Sheets

(56) References Cited

U.S. PATENT DOCUMENTS

| | | | | |
|---|---|---|---|---|
| 6,386,532 | B1 * | 5/2002 | Donovan | B25B 5/06 269/25 |
| 6,457,338 | B1 * | 10/2002 | Frenken | B21D 39/04 29/708 |
| 6,644,636 | B1 * | 11/2003 | Ryan | B25B 5/06 269/156 |
| 6,860,017 | B1 * | 3/2005 | Mennicken | A45D 29/02 29/268 |
| 8,336,362 | B2 * | 12/2012 | Frenken | B21D 39/04 72/416 |
| 2007/0214859 | A1 * | 9/2007 | Bowles | B21D 39/048 72/412 |
| 2010/0327507 | A1 * | 12/2010 | Clark | B25B 5/04 269/207 |
| 2012/0174361 | A1 * | 7/2012 | Wang | B25B 7/14 29/229 |
| 2017/0317461 | A1 * | 11/2017 | Wason | H01R 43/0427 |

FOREIGN PATENT DOCUMENTS

| | | | |
|---|---|---|---|
| EP | 0860245 | A2 | 8/1998 |
| EP | 2072188 | A1 | 6/2009 |

* cited by examiner

PRESSING TOOL WITH SWITCHBLADE BISTABLE TENSIONING MECHANISM

CROSS-REFERENCE TO RELATED APPLICATION

This application claims priority to German Patent Application No. 10 2014 112 869.9 filed Sep. 8, 2014, the disclosure of which is hereby incorporated in its entirety by reference.

BACKGROUND OF THE INVENTION

Field of the Invention

The invention relates to a pressing tool for joining a pipe and a fitting, particularly in an undetachable manner, comprising two swivel elements for pressing the pipe and the fitting, a receiving region formed between the swivel elements for receiving the pipe and the fitting, at least one swivel axis for rotatably mounting the swivel elements and a tensioning mechanism for pretensioning the pressing tool, wherein the swivel elements can be swivelled relative to one another about the at least one swivel axis for pressing the pipe and the fitting, wherein in a first closed position, the receiving region is narrower than in a second open position of the swivel elements, wherein the swivel elements are pretensioned towards the closed position by the tensioning mechanism, and wherein at least one holding device is provided for holding the swivel elements in the open position against the pretensioning force generated by the tensioning mechanism.

Description of Related Art

Pressing tools of the type mentioned above are already known and are used, for example, during the installation of pipeline systems for the supply of drinking water or gas and during the installation of sewage plants, air conditioning systems or fire protection systems. In practical use, the swivel elements of the pressing tool engage around the periphery of the pipe to be pressed and of the fitting. In this respect, the swivel elements, being pretensioned by the tensioning mechanism, rest against the outer peripheral surface of the fitting or sleeve to be pressed. When the tool and the components to be pressed have been correctly positioned relative to one another, the cold pressing procedure is usually carried out by a machine which acts on the swivel elements.

If a user wishes to use a pressing tool of this type, on the one hand he has to bring the components to be pressed into the intended pressing position and hold them there, and on the other hand he has to press the swivel elements against one another in a manner which stresses the tensioning mechanism to prepare the pressing tool to receive the components, and he must also bring the pressing tool and the machine associated therewith into the intended pressing position and hold them there. Therefore, there are three points which the user must consider. In practice, the user can possibly be helped by another person who assumes one of the three previously mentioned actions. Furthermore, the user can perform the first of the previously mentioned actions using technical aids, for example by fixing the components which are to be pressed, before the pressing tool is attached. However, it is difficult for the user to use a previously described pressing tool if he wants to carry out the pressing procedure unaided or without further technical aids, particularly if the components are not fixed separately.

DE 10 2007 061 164 discloses a pressing tool in which two swivel elements are spring-preloaded relative to one another and can be held on the one hand in a closed position and on the other in an open position. A bistable tensioning mechanism is provided for this purpose. The advantage of this tool that pressing procedures are easily possible in difficultly accessible regions using the bistable tensioning mechanism is opposed by the disadvantage that the holding or locking function in the open position possibly prevents the user from rapidly performing a plurality of successive pressing procedures. Thus, some users prefer tools which are simply pretensioned in a conventional manner, while other users favour the bistable tensioning mechanism.

Therefore, the technical problem of the present invention is to provide a pressing tool which is more flexible to handle and which optimally manages a greater variety of different assembly situations.

SUMMARY OF THE INVENTION

The previously mentioned technical problem is solved according to the invention in that the holding device is switchable and in that the holding device and the tensioning mechanism form a switchable, bistable tensioning mechanism.

It has been found that a pressing tool which is more flexible to handle and which optimally manages a greater variety of different assembly situations can be provided by the solution according to the invention. Consequently, the pressing tool according to the invention can be used in two different ways. In one operating mode, only the tensioning mechanism acts on the swivel elements so that they are pretensioned towards the closed position. In order to hold the swivel elements in the open position, a user has to actively hold the swivel elements open against the pretensioning force generated by the tensioning mechanism. If there is no action by the user, the swivel elements remain in the closed position or they fall back into the closed position due to the effect of the tensioning mechanism. In a second operating mode, the holding device is switched and, together with the tensioning mechanism, it forms a bistable tensioning mechanism. This means that when the holding device is connected, the swivel elements of the pressing tool can be swivelled into two stable states in which they remain without the effect of an impulse or of an applied force from outside.

In this respect, the closed position of the swivel elements can be the first stable position, while the second stable position is the open position. In this respect, in the open position, the switched holding device acts against the pretensioning force generated by the tensioning mechanism, so that the pressing tool remains in the open position. If, due to the action by an operator, the swivel elements are transferred from the open position into the closed position, the swivel elements are held in the closed position by the tensioning mechanism.

In order to transfer the swivel elements from one stable position into the other stable position, the impulse or external application of force must be given such that the swivel elements are swivelled relative to one another beyond the unstable intermediate position located between the stable positions by the impulse or introduction of force, the swivel elements falling into the respective other stable position after passing through this unstable intermediate position. The unstable intermediate position is the swivel position of the swivel elements relative to one another in which the effect of the tensioning mechanism and of the holding device cancel each other out so that the moment about the swivel axis is zero.

A user can manually actuate the swivel elements, for example, to swivel them out of the closed position into the open position or vice versa. An impulse or an application of force which transfers the pressing tool out of the open position into the closed position or allows it to snap into the closed position can be introduced into the tool, for example by a machine associated with the pressing tool for pressing the components. In this case, the user can carry out the pressing of the components without grasping the machine further after he has positioned the components which are to be pressed in the receiving region of the pressing tool.

The bistable tensioning mechanism simplifies the handling of the pressing tool. Thus, the pressing tool can be positioned relative to the components to be pressed with swivel elements held in the open position by the holding device, wherein the user can concentrate only on the correct positioning of the pressing tool with the tool which has been pre-set in this manner. The pressing tool, together with an appropriate machine, can be brought into position single-handedly by the user, for example.

Thus the user can decide whether or not the pressing tool is to be held in the open state by the holding device before the pressing procedure of the pipe and fitting. The pressing tool according to the invention thus combines the advantages of conventional, simply pretensioned pressing tools with the advantages of tools which provide a fixing of the swivel elements in an open position. Therefore, the respective user is provided with a flexibly usable pressing tool which has an optionally switchable holding function of the swivel elements in the open position.

According to an embodiment of the pressing tool, the holding device has in the open position of the swivel elements a first switch position in which the tensioning mechanism is released. The holding device also has in the open position of the swivel elements a second switch position in which the holding device counteracts the tensioning mechanism. Therefore, in the first switch position, the holding device is not connected and in this case, it does not act on the tensioning mechanism. In the second switch position, the holding device is connected and holds the swivel elements, which have been swivelled into the open position, in the open position against the force generated by the tensioning mechanism. It is thereby particularly simple to operate the pressing tool, because the user merely has to choose between two switch positions of the holding device in order to switch on or switch off the bistable tensioning mechanism.

In the second switch position, the holding device can be braced resiliently. The resilient bracing ensures a reliable holding function of the holding device in the open position, it being possible for a defined counterforce of the holding device to oppose the pretensioning force of the tensioning mechanism with a high repetition accuracy so that the holding device and the tensioning mechanism do not become undesirably uncoupled. In particular in this respect, both the tensioning mechanism and the holding device can have a spring, said springs being, subject to the switch position of the holding device, braced against one another. The tensioning mechanism and the holding device can be produced in a particularly simple and economical manner due to the interconnection of two springs. In particular it is possible to easily adjust the actuating power respectively required for changing between the positions of the swivel elements by the configuration of the springs.

According to a preferred embodiment of the pressing tool, the holding device has at least one locking element and at least one locking recess, the locking element interacting with the locking recess in the second switch position. The interaction between locking element and locking recess can produce a defined contact region, such as, e.g., a contact surface, via which the holding forces are transmitted between the holding device and the tensioning mechanism. Thus, by means of the locking recess and the locking element, a defined open position can be predetermined in which the swivel elements are held by the holding means. The receiving region thereby has in this position a predetermined receiving width for introducing appropriate pipe and fitting diameters. The coupling of the locking element and the locking recess can be a positive fit and/or a force fit. The mutually contacting regions of the locking element and locking recess can be pressed against one another, for example by the forces introduced into the swivel elements by the tensioning mechanism. In this respect, the locking element can engage in a locking recess, at least portions of which are formed in a complementary manner.

The locking element and the locking recess can be provided on/in two different components which can be swivelled about the swivel axis relative to one another, at least one of the components being one of the swivel elements. In this way, it can be ensured that a moment, introduced into the swivel elements by the tensioning device, about the swivel axis can be supported by the holding device in the open position of the swivel elements.

Thus, the locking recess and the locking element can be provided on both swivel elements. The locking recess or the locking element can also be provided on a housing or on a support element, said housing or support element supporting the swivel axis, for example. A housing or support element of this type can be particularly required if each of the swivel elements is held on a separate swivel axis, the swivel axes being fixed relative to one another with respect to their relative position in the housing or support element. The housing or support element can be configured in one or more parts for production and assembly reasons and can contribute in particular to the rigidity of the pressing tool. Furthermore, the housing or support element can be used as a coupling point for coupling a machine to the pressing tool.

According to a first preferred embodiment of the pressing tool, the locking element can be a substantially cylindrical bolt and the locking recess can be a depression formed in a leaf spring. The use of the cylindrical bolt in interaction with a leaf spring has the advantage that these components can be integrated in a particularly space-saving manner into the pressing tool. The bolt is preferably arranged substantially parallel to the swivel axis. The leaf spring is arranged in particular between the bolt and the swivel axis. In particular, the leaf spring is directed away from the swivel axis, is curved outwards in the direction of the bolt and has a substantially rectangular basic form. The length of the leaf spring corresponds to at least three times the width thereof and is at least partly curved around the swivel axis along its longitudinal side. In the width direction, the leaf spring is oriented substantially parallel to the swivel axis.

According to an embodiment of the pressing tool, the bolt is displaceable in an axial direction between the first switch position and the second switch position and in the first switch position, the bolt is at a distance from the leaf spring and in the second switch position, it rests peripherally on the leaf spring. When the bolt is in the first position, the bolt and the leaf spring do not counteract a swivelling action out of the open position into the closed position because the distance between the bolt and the leaf spring allows a free swivelling of the swivel elements. In the second switch position, the bolt engages positively in the recess in the leaf spring. In the open position of the swivel elements, the contact region between the leaf spring and the bolt forms an abutment against which the swivel elements are supported against a swivelling movement, caused by the tensioning mechanism, out of the open position into the closed position. Therefore, in the second switch position, the leaf spring itself and the frictional contact between the leaf spring and the bolt counteract a sliding movement of the bolt along the locking recess. In further embodiments of the invention, it is possible for the leaf spring and the bolt to form a substantially punctiform or linear contact region with respect to one another.

The bolt is consequently a mechanical switch, the displacement of the bolt in an axial direction corresponding to the switching according to the invention of the holding device. In addition to the switching function, the bolt, while interacting with the leaf spring, simultaneously produces the coupling between the tensioning mechanism and the holding device. The bolt can be guided by sliding along a hole so that a defined substantially clearance-free guidance of the bolt is ensured between the first and second switch positions. Therefore, together with the leaf spring, the bolt combines the switching and the coupling functions. In this way, a compact, robust and economical representation of the switching and coupling function in the pressing tool is possible. Furthermore, the leaf spring makes it possible to achieve a bistable coupling of the swivel elements which are pretensioned by the tensioning mechanism.

In addition, the switching and coupling functions can be divided up onto two or more separate components. Thus, a separate switch can act on a bolt or on a separate coupling element, it being possible for the switch and the coupling element to have electrical and/or electromagnetic and/or pneumatic switching elements and/or actuators.

The bolt preferably rests on a guide rail which holds the bolt in the respective axial switch position. In this way, it is possible for the bolt to be secured against an undesirable displacement out of the respective switch position in any swivel and switch position.

The guide rail is preferably a leaf spring. Therefore, the guide rail configured as a leaf spring allows the bolt to be braced in the respective switch position so that it is held securely in the respective switch position, particularly in the case of the first switch position in which there is no contact in the region of the locking recess.

According to a further embodiment of the pressing tool, the bolt has on the portion associated with the guide rail two mutually spaced apart, peripherally running grooves which interact with a guide path of the guide rail in the respective switch position. In this way, the bolt is held in a positive fit in the respectively selected switch position.

According to a second preferred embodiment of the pressing tool, the locking element has a sliding element which is slidably guided on one swivel element, the sliding element being displaceable between the first switch position and the second switch position, and the locking recess being formed in the other swivel element. The swivel elements can be hooked into one another by means of the locking element and the locking recess. The locking element can be configured particularly in the manner of a clip or clamp. The switching and coupling functions are thereby united in a combination of locking element and locking recess and thus provide a robust and easily operable pressing tool. The locking element and locking recess are preferably positioned on a side of the swivel elements remote from the receiving region so that the switchable holding device is arranged with easy access.

In this respect, the sliding element can be held in a pretensioned manner in the first switch position. This measure ensures on the one hand that when the sliding element is not being used, it rests fixedly against the pressing tool and does not obstruct the operator's use of the tool. On the other hand, the pretensioning prevents the holding device from being inadvertently connected by the operator. A pretensioning force of this type can be generated, for example by a helical compression spring which is arranged between the swivel element and the sliding element. Furthermore, the helical compression spring can predetermine the adjustment travel which the user has to overcome against the resilience of the helical compression spring in order to engage the locking element in the locking recess.

According to a further preferred embodiment of the pressing tool, two sliding elements are provided on, and two locking recesses are provided in the swivel elements. The pressing tool can thereby be braced symmetrically in the open position. In further embodiments of the invention, the locking recesses are provided in the sliding elements themselves so that the sliding elements of the swivel elements mutually engage in one another. This type of holding device can be retrofit particularly easily on an existing pressing tool.

According to a third preferred embodiment of the pressing tool, the locking element is a pressure piece. A pressure piece of this type can be a conventional resilient pressure piece which interacts with the locking recess in the second switch position in order to hold the swivel elements in the open position. The pressure piece can have in particular a locking ball which is resiliently pretensioned in the first switch position and which sits in a locking recess, formed as a depression, in the second switch position. The pressure piece is preferably substantially relaxed in the second switch position. Thus, the holding device can be simply formed from a locking recess and a pressure piece which is known per se and is economically available in many different configurations.

In an advantageous development of this embodiment of the pressing tool, the pressure piece is attached to one of the swivel elements and the locking recess is provided in a support element supporting the swivel axis. In this case, the pressure piece together with the swivel element can be swivelled about the swivel axis relative to the support element. Thus, the pressure piece can be simply switched from the first switch position into the second switch position (and vice versa) in that when the swivel element is swivelled with a spring-loaded locking body of the pressure piece, such as a locking ball, the pressure piece is guided on the end face along a defined outer contour of the support element, which outer contour merges into the locking recess. In particular, this outer contour can be formed by a guide surface, remote from the swivel axis, of the support element. The pressure piece can have an external thread and can be screwed into a mount provided in the swivel element.

Therefore, the pressure piece can preferably have a locking ball which, in the closed position of the swivel elements, is braced resiliently against the guide surface of the support element in the direction of the swivel axis. During the swivelling of the respective swivel element, to which the pressure piece is attached, out of the closed position into the open position, the locking ball held in the pressure piece slides or rolls along the guide surface towards the depression. If, as the swivel elements are being swivelled, a swivel position fixed by the transition from the guide surface to the depression is passed, the locking ball moves into the depression due to the spring force. The position of the locking ball in the depression represents the second switch position of the holding device. In the second switch position, the pressure piece counteracts a swivelling movement, caused by the tensioning mechanism, of the swivel elements into the closed position so that the swivel elements are held in the open position.

Therefore, the holding device is preferably switched by the swivelling of the respective swivel element fitted with the pressure piece beyond a predetermined swivel position, it being possible for the swivel position to be constructively defined by the arrangement of the locking recess or by the relative arrangement of pressure piece and locking recess relative to one another.

The receiving region formed between the swivel elements when transferring the swivel elements from the closed position into the open position before reaching the swivel position which, when passed, causes the locking ball to move into the depression, is preferably already so wide open that the entire spectrum of the pipe cross sections and fittings to be joined by the pressing tool in question can be introduced into the receiving region to produce an undetachable pressed joint. In other words, even in the first switch position of the holding device, the pressing tool is unrestrictedly suitable for pressing the pipe cross sections respectively provided for this tool without the swivel elements being fixed in the open position by the pressure piece, the position of the locking ball moved out of the locking recess in the open position being the first switch position of the holding device. The respective user can therefore decide whether the swivel elements of the pressing tool are to be held in the open position by swivelling the swivel elements until the locking ball moves into the depression or whether not to do so. Consequently, the holding device can easily be connected without a grasping action being required while the swivel elements are being swivelled out of the closed position into the open position.

In order to swivel the swivel element, which is held in the open position by the pressure piece, out of the open position into the closed position, the resistance formed by the first pressure piece and the locking recess has to be overcome. In the case of the previously described locking ball which sits in a depression, to swivel the swivel element into the closed position, a restoring force is required which causes the locking ball to slide or roll out of the depression towards the guide surface, the locking ball moving into the pressure piece along the surface of the depression, which rises towards the guide surface, against the spring of the pressure piece.

So that an operator does not inadvertently fix the pressing tool in the open position of the swivel elements when spreading apart the swivel elements, in addition to a first pressure piece it is possible to provide a second pressure piece which counteracts a swivelling of the swivel elements out of the closed position into the open position in a swivel range, the open position in particular being part of the swivel range. In this manner, the second pressure piece can define a pressure point in that the resistance for spreading apart the swivel elements in a swivel range immediately before reaching the swivel position which, when passed, causes the locking ball to move into the depression, is increased.

The second pressure piece can be provided on a swivel element and can interact with a support element supporting the swivel axis of the swivel element. The second pressure piece can be a resilient pressure piece with a resiliently pretensioned locking ball. In the closed position of the swivel elements, the second pressure piece, in particular the locking ball of the second pressure piece is arranged at a distance from the support element. By swivelling the swivel elements out of the closed position towards the open position, the locking ball engages with the support element in the swivel range. Preferably formed in the swivel range is a second depression into which the locking ball of the second pressure piece moves due to the swivel movement. As a result of the interaction between the spring-loaded locking ball of the second pressure piece and the second depression, an additional resistance opposes the swivelling of the swivel elements before the swivel position is reached which, when passed, causes the locking ball of the first pressure piece to move into the depression.

The first and second pressure pieces can be provided on different swivel elements. In this respect, the movement of the two swivel elements about the respectively associated common or separate swivel axes can be coupled by a transmission, so that a swivelling movement of one swivel element causes a swivelling movement of the other swivel element. Thus, the first pressure piece can be provided on a first swivel element and the second pressure piece can be provided on a second swivel element, both the first and the second pressure pieces acting on both swivel elements via the transmission.

A transmission of this type which couples the swivel movement of the swivel elements can also be provided on one of the previously described embodiments of the pressing tool. This has the advantage that even a single holding device, provided on one of the swivel elements, is sufficient to hold the two swivel elements in the open position.

As an alternative or in addition to the second pressure piece, it is possible to provide on the pressing tool a marking which indicates to the respective user the swivel position which, when passed, causes the locking ball of the first pressure piece to move into the depression or causes a switching of the first pressure piece.

BRIEF DESCRIPTION OF THE DRAWINGS

In the following, the invention will be described in more detail with reference to embodiments shown in the drawings, in which.

DETAILED DESCRIPTION OF THE INVENTION

Figure 1A:
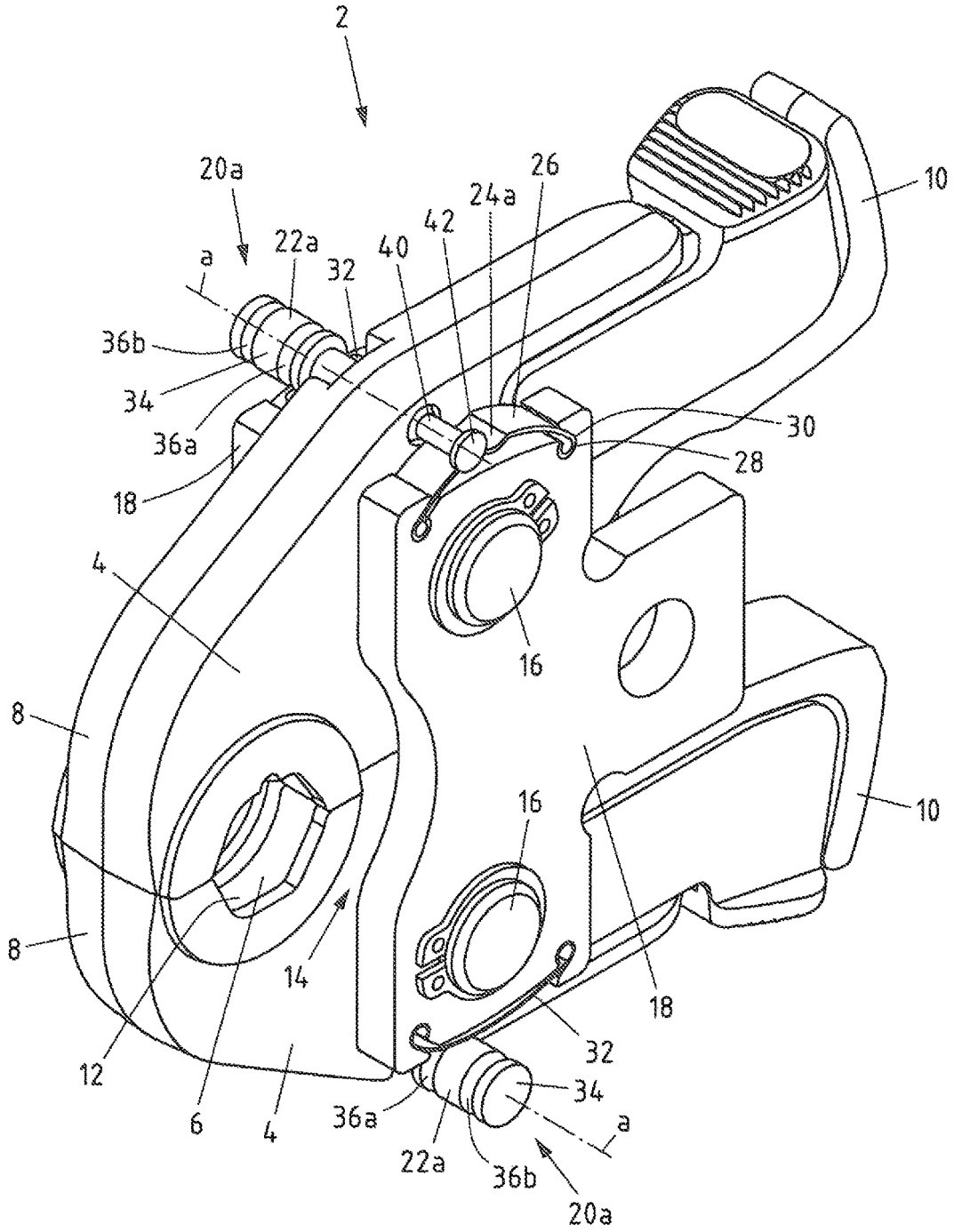
FIGS. 1*a*, 1*b* are two perspective views of a first embodiment of a pressing tool according to the invention in the closed position, with holding devices in a first switch position.
Figure 1B:
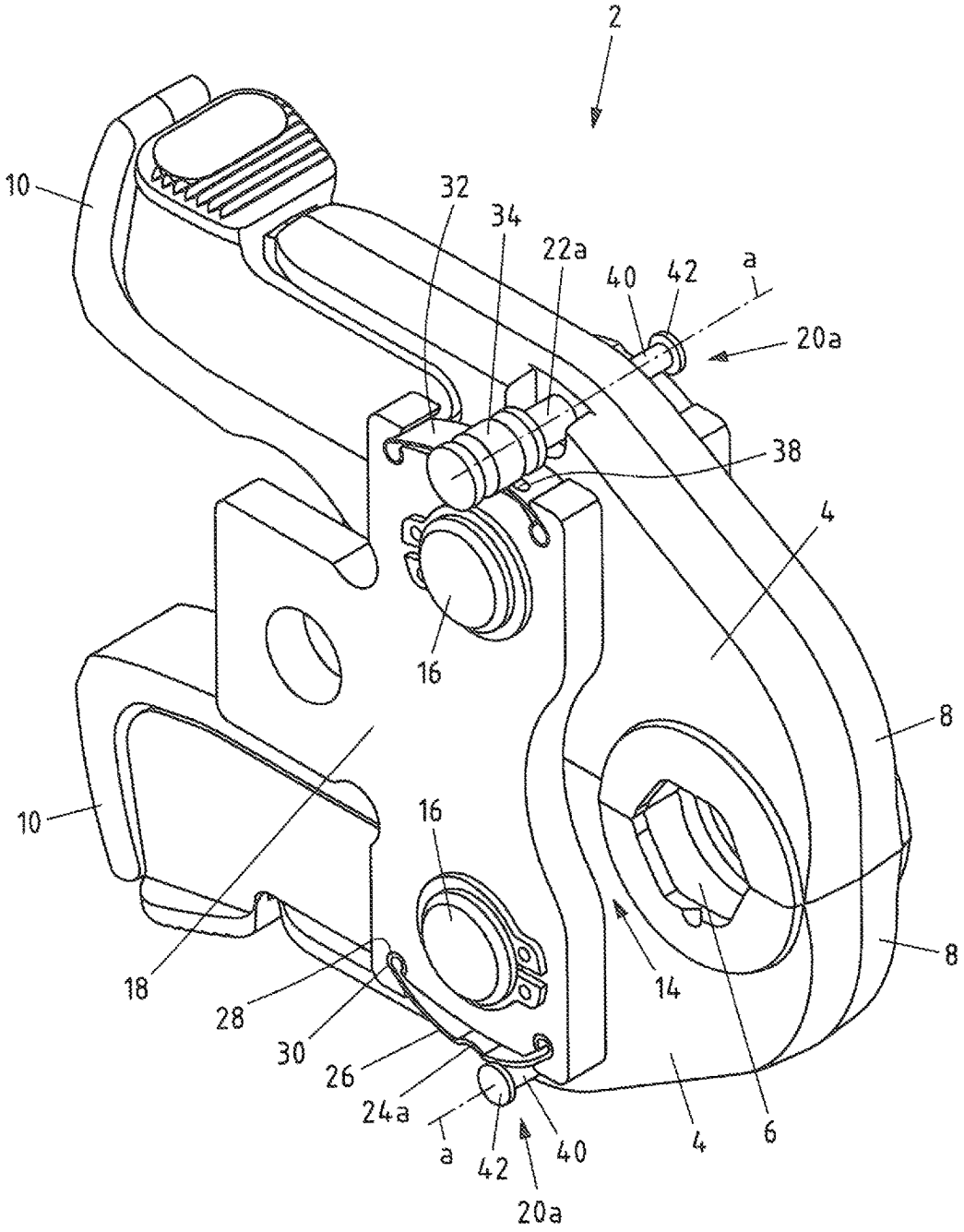
Figure 1C:
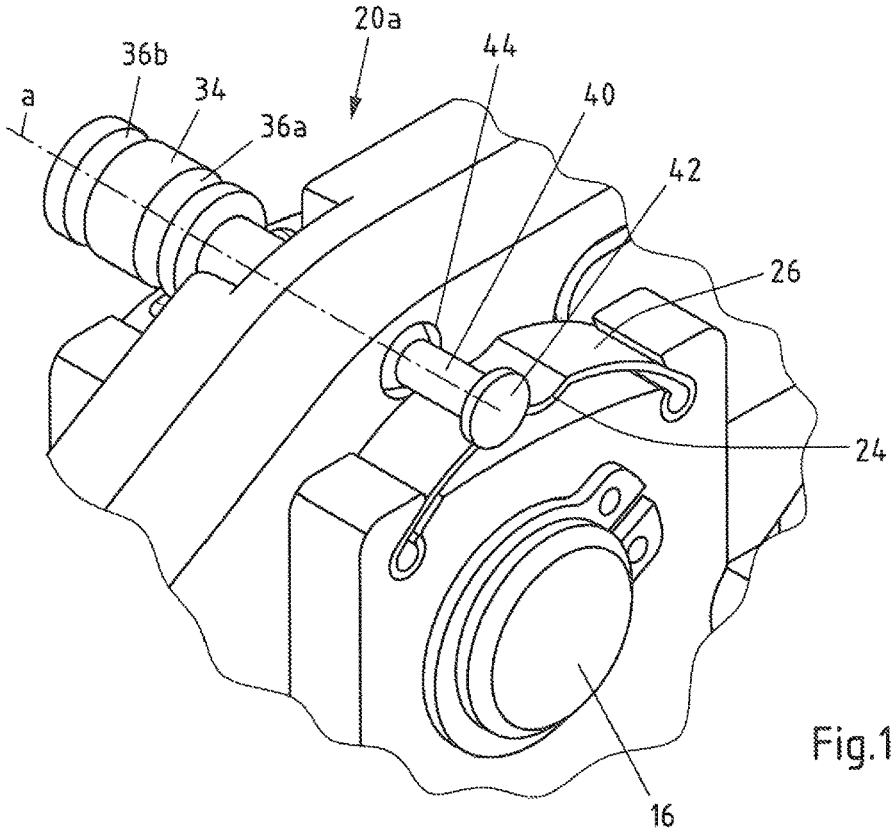
FIGS. 1*c*, 1*d* are two perspective views of enlarged details of the pressing tool from FIG. 1*a* and FIG. 1*b* in the closed position, with the holding devices in the first switch position.
Figure 1D:
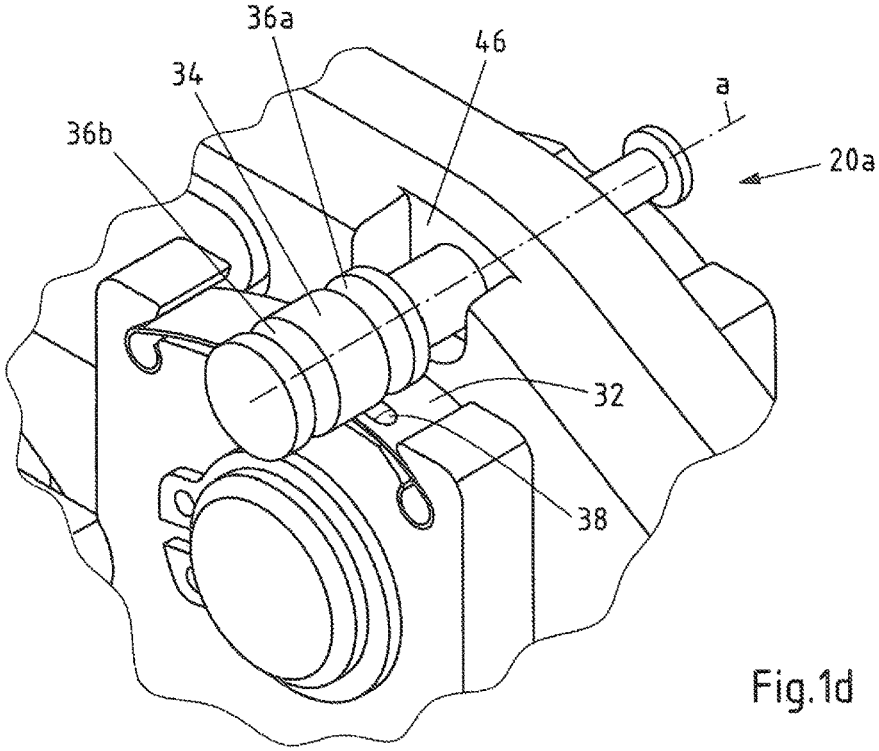
Figure 2A:
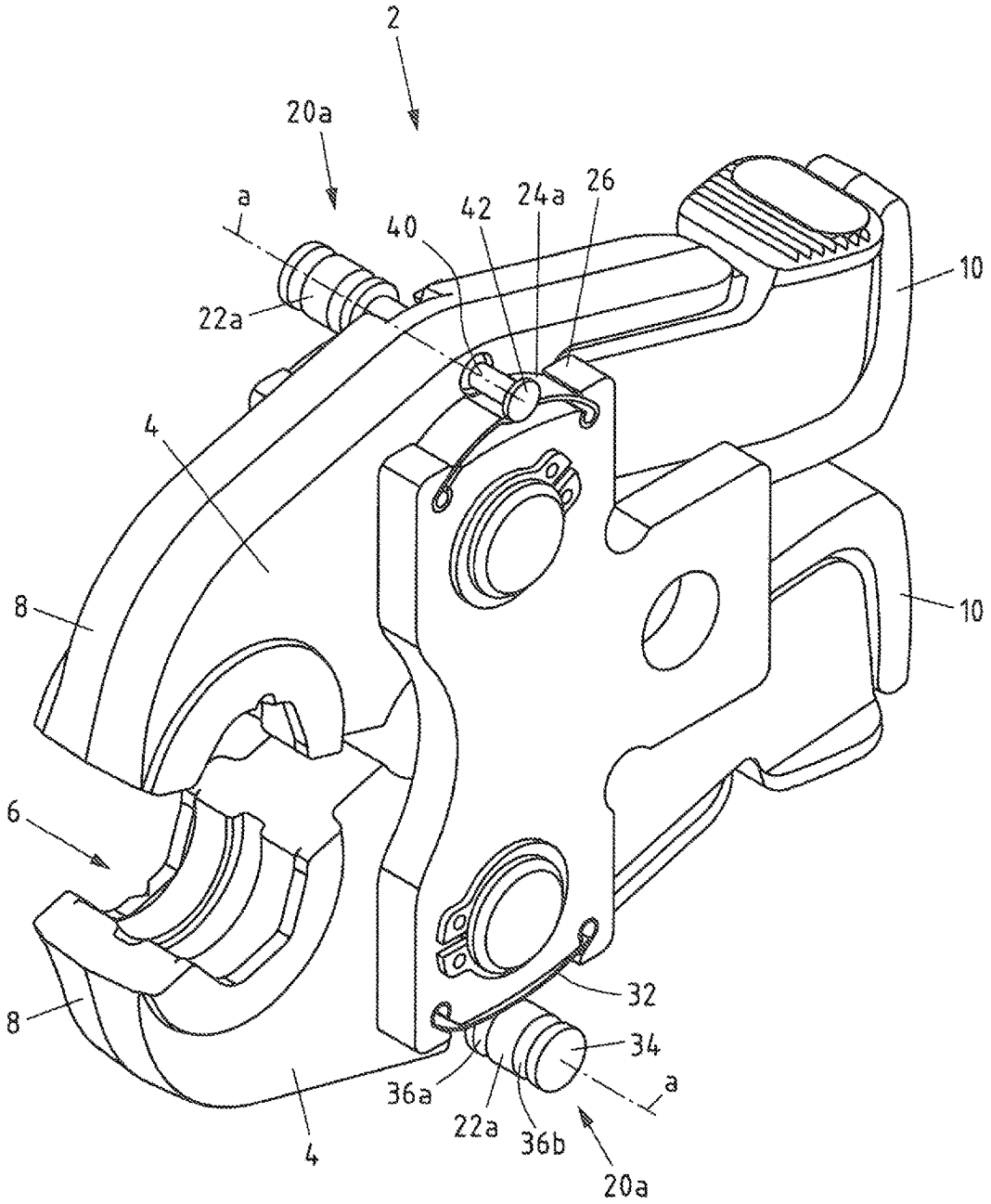
FIGS. 2*a*, 2*b* are two perspective views of the pressing tool from FIG. 1 in an open position, with the holding devices in the first switch position.
Figure 2B:
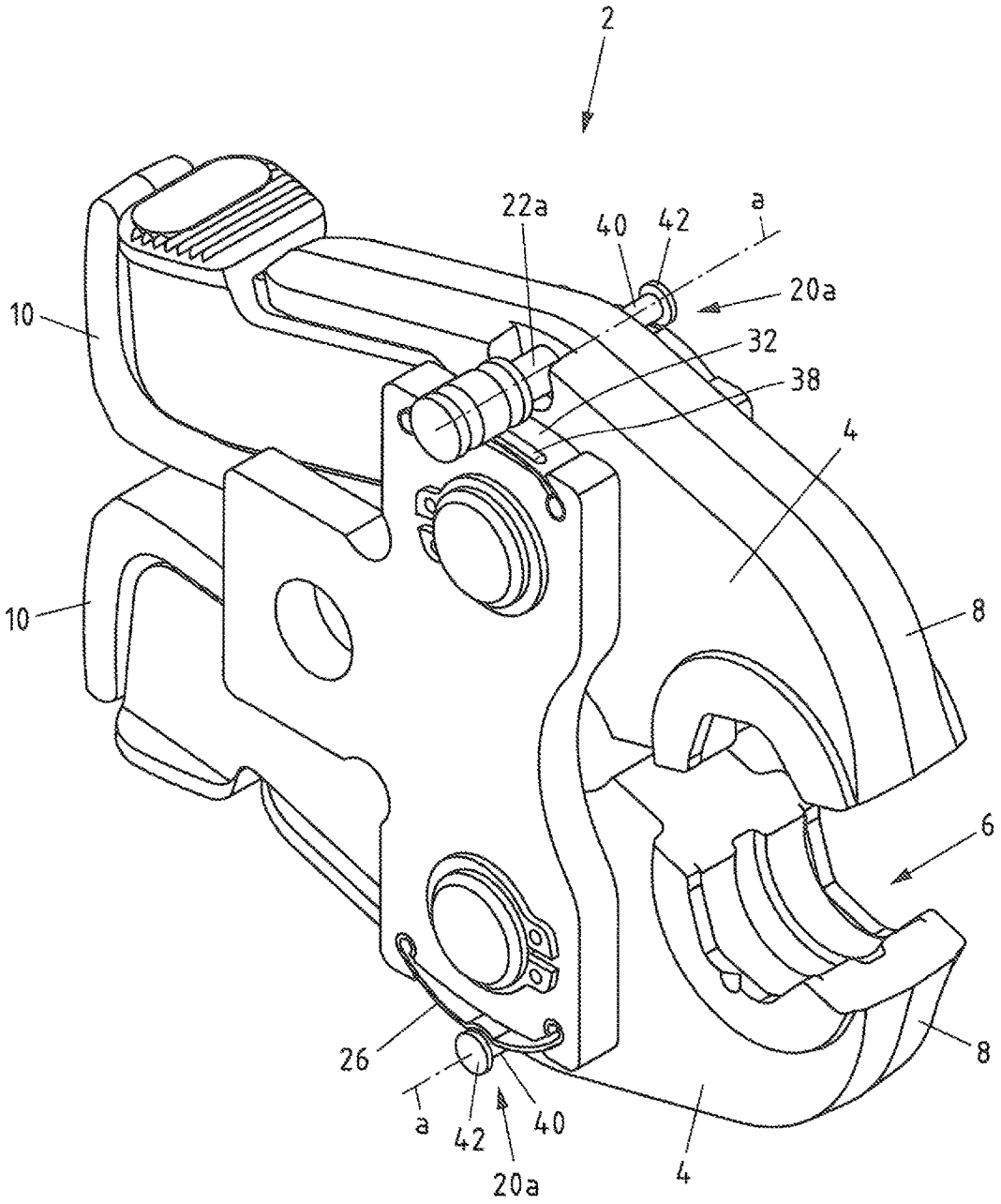
Figure 2C:
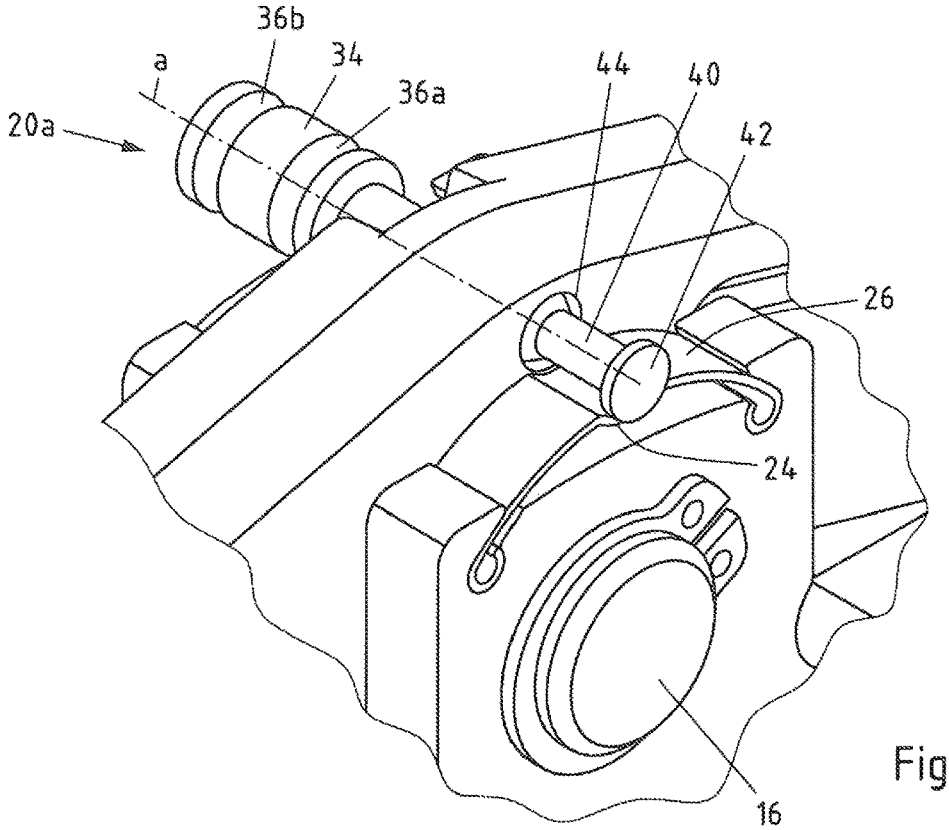
FIGS. 2*c*, 2*d* are two perspective views of enlarged details of the pressing tool from FIG. 2*a* and FIG. 2*b* in an open position, with the holding devices in the first switch position.
Figure 2D:
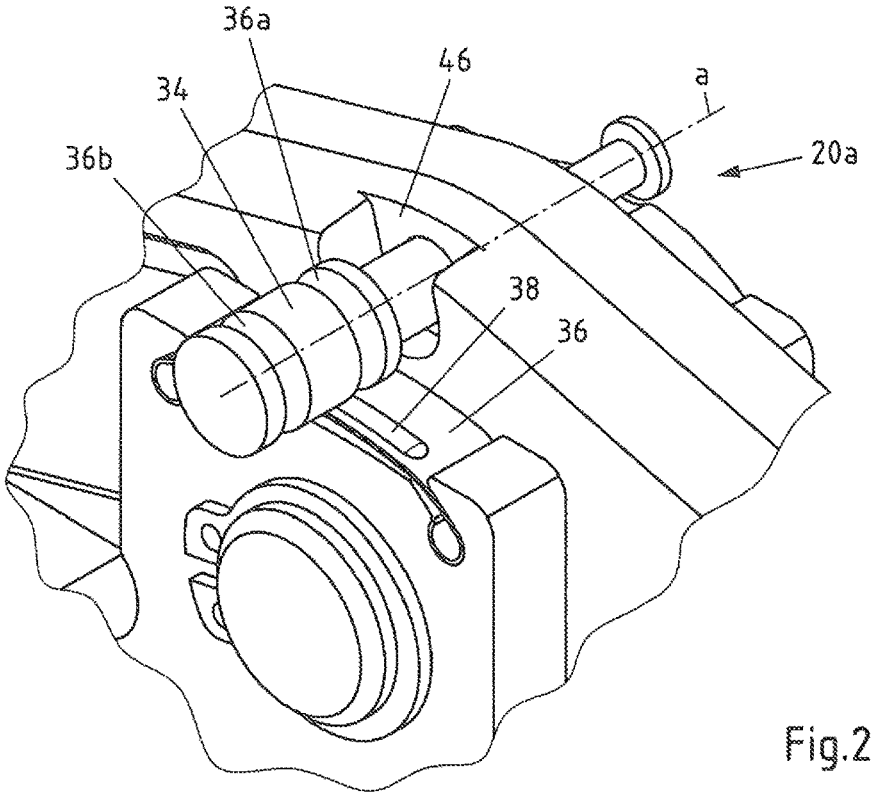

FIG. 1 shows two perspective views of an embodiment of a pressing tool 2 according to the invention for joining a pipe (not shown) and a fitting (not shown), in a closed position with holding devices 20*a* in a first switch position A.

The pressing tool 2 has two swivel elements 4 for pressing the pipe and the fitting. The pressing tool 2 has a receiving region 6, formed between the swivel elements 4, for receiving the pipe and the fitting. The swivel elements 4 each have a pressing portion 8 and an actuating portion 10. In practical use, the actuating portions 10 are used to introduce the pressing forces via a machine (not shown). The inner contours 12 of the pressing portions 8 form the receiving region 6. During the pressing procedure, the receiving region 6 is transferred from an open position (FIG. 2) into a closed position (FIG. 1), the receiving region 6 being narrower in the closed position of the swivel elements 4 than in the open position of the swivel elements 4.

Located between the swivel elements 4 is an tensioning mechanism 14 (not shown) located on the inside which comprises a pretensioning spring for pretensioning the pressing tool 2 towards the closed position. The swivel elements 4 are mounted rotatably on the swivel axes 16. The swivel elements 4 can be swivelled about the swivel axes 16 towards to one another for pressing the pipe and the fitting. The swivel axes 16 are mounted in the support elements 18.

The pressing tool 2 has two holding devices 20*a* for holding the swivel elements 4 in the open position (FIG. 3) against the force generated by the pretensioning spring, the holding devices 20*a* being switchable. The holding devices 20*a* and the tensioning mechanism 14 form a switchable, bistable tensioning mechanism.

The respective holding device 20*a* has a locking element 22*a* and at least one locking recess 24*a*. The locking element 22*a* is a substantially cylindrical bolt 22*a* and the locking recess 24*a* is a depression 24*a* formed in a leaf spring 26. The leaf spring 26 is held in a positive fit by its end portions 28, which are bent back substantially circularly at the ends, in a mount 30 of the support element 18, at least portions of said mount being formed in a complementary manner.

The respective bolt 22*a* of one of the holding devices 20*a* rests on a guide rail 32 which secures the bolt 22*a* in an axial direction along the axis a of the bolt 22*a* against an undesirable movement. The guide rail 32 is a leaf spring 32 which is attached to the support element 18 opposite the leaf spring 26. The bolt 22*a* has on its portion 34 associated with the guide rail 32 two mutually spaced apart, peripherally running grooves 36*a*, 36*b* which interact with a guide path 38 of the guide rail 32. The guide path 38 is curved towards the bolt 22*a*. The grooves 36*a*, 36*b* have a respective groove cross section which is formed in a substantially complementary manner to the curvature of the guide path 38. The guide path 38 and the grooves 26*a*, 26*b* engage in a positive fit with each other. Bolt 22*a* is secured against displacement in an axial direction by the guide path 38 and the grooves 36*a*, 36*b*. Therefore, when the swivel elements 4 are swivelled relative to the support element 18, bolt 22*a* is guided along the guide path 38 relative to the support elements 18.

Figure 3A:
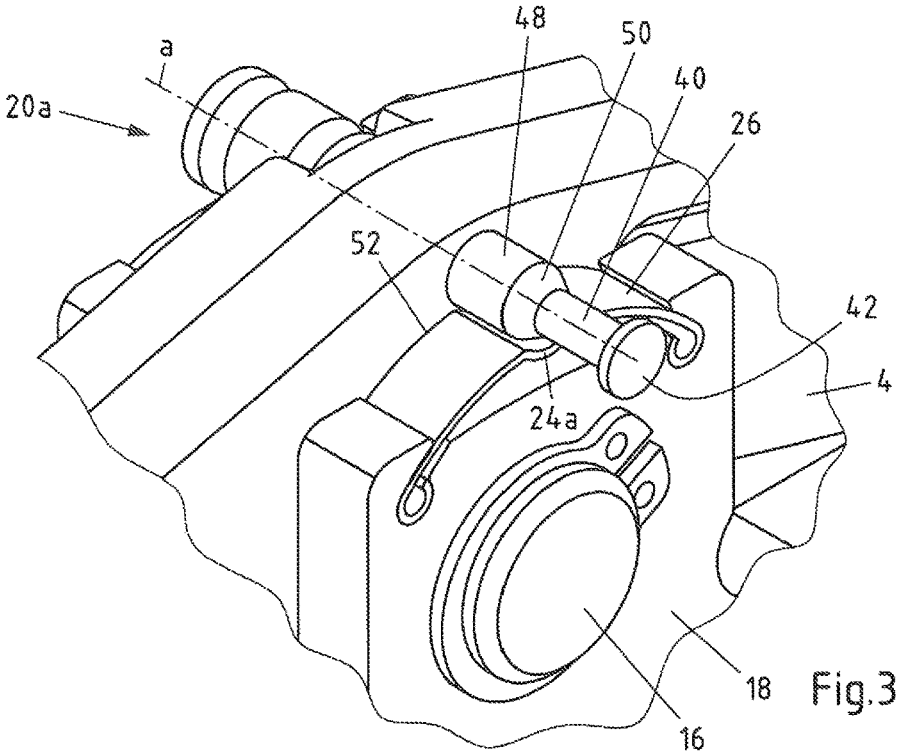
FIGS. 3*a*, 3*b* are two perspective views of enlarged details of the pressing tool in an open position, with the holding devices in a second switch position.
Figure 3B:
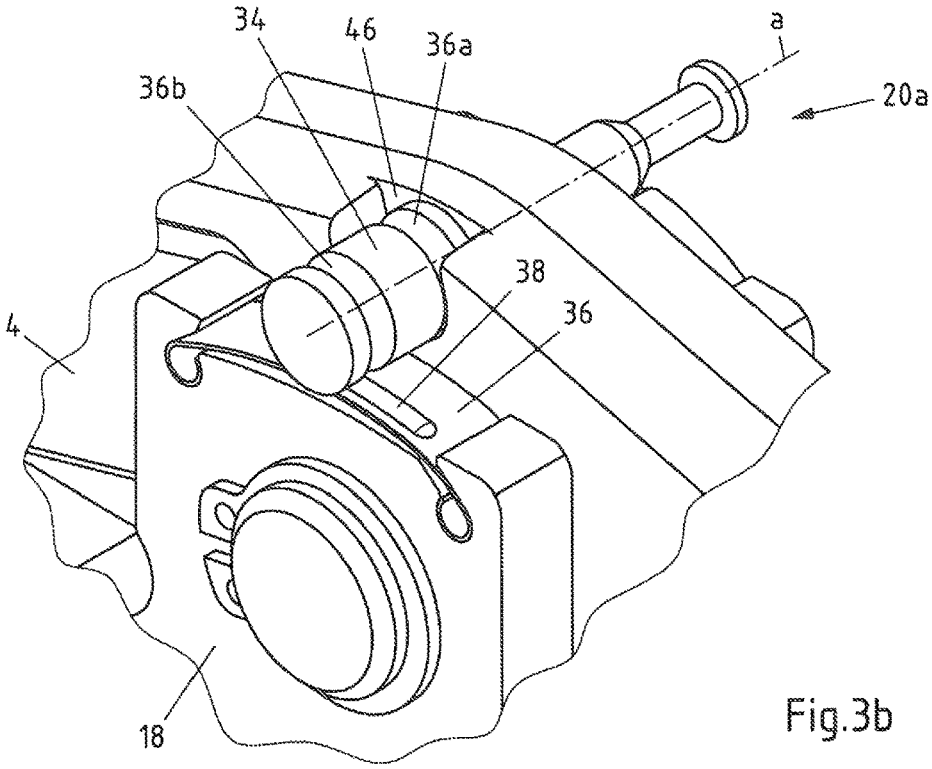

FIG. 2 shows the pressing tool 2 from FIG. 1 in an open position, with the holding devices 20*a* in the first switch position A. FIG. 3 shows two perspective views of enlarged details of the pressing tool 2 from FIG. 1 in an open position, with the holding devices 20*a* in a second switch position B. The bolts 22*a* of the holding devices 20*a* are displaceable in an axial direction between the first switch position A and the second switch position B, said bolts 22*a* being at a distance from the leaf spring 26 in the first switch position A and resting peripherally on the leaf springs 26 in the second switch position B.

To swivel the swivel elements 4 out of the closed position (FIG. 1) into the open position (FIG. 2, FIG. 3), a user has to press the swivel elements 4 together in the region of the actuating portions 10 against the pretensioning force of the tensioning mechanism 14. The actuating portions 10 are moved towards one another while the pressing portions 8 are spread apart and thus the receiving region 6 is opened.

In switch position A of the holding devices 20*a* shown in FIG. 2, the holding devices 20*a* do not counteract the tensioning mechanism 14 and the tensioning mechanism 14 is released. When the user releases the actuating portions 10 in the open position of the swivel elements 4, said swivel elements 4 are moved back into the closed position due to the resilient force of the tensioning mechanism 14 (FIG. 1). The respective bolt 22*a* is also guided by a guide portion 40 which projects over the width of the leaf spring 26 in the first switch position A and has a circularly running web 42 which rests laterally on the leaf spring 26.

The holding devices 20*a* allow the user to fix the swivel elements 4 in a resiliently braced manner in the open position. For this purpose, in the open position, the bolts 22*a* are moved along their respective axis a in an axial direction out of switch position A into switch position B which is shown in FIG. 3.

The axes a of the bolts 22*a* and the swivel axes 16 run substantially parallel to one another. The bolts 22*a* are guided such that they slide in the holes 44 in the respective swivel element 4. When a bolt 22*a* is moved out of switch position A into switch position B, the groove 36*a* encompassing the guide path 38 in switch position A slides on the guide path 38 with the groove inner face rising against the direction of movement and presses the guide rail 32 towards the support element 18. The bolt 22*a* is moved towards switch position B until the guide rail 32 engages with the guide path 38 in the respective other groove 36*b*. In this respect, the bolt 22*a* sits with a partial length of the portion 34 in a guide depression 46 which is formed in the swivel element 4 and against which the bolt 22*a* is laterally supported during the swivelling movement of the swivel elements 4.

The diameter of portion 48 of the bolt 22*a* contacting the leaf spring 26 in switch position B (FIG. 3) substantially corresponds to the diameter of the hole 44. Starting from the diameter of the bolt portion 48, the bolt 22*a* is tapered conically towards the guide portion 40 so that a circularly running bevel 50 is provided between the bolt portion 48 and the guide portion 40. When a respective bolt 22*a* is moved out of switch position A into switch position B, the bolt with bevel 50 threads into the depression 24*a* to ensure the correct position of the bolt 22*a*. When the bolt 22*a* is pushed onto the leaf spring 26, the bolt 22*a*, with the help of the bevel 50, displaces the leaf spring 26 towards the support element 18 so that the bolt 22*a* and the leaf spring 26 are braced against one another. In this respect, the bevel 50 slides on the side edge 52 of the leaf spring 26 facing the hole 44.

FIG. 3 shows the pressing tool 2 with swivel elements 4 held in an open position, the bolts 22*a* being in switch position B. The bolts 22*a* rest in each case on the leaf springs 26 by their portion 48 associated with the leaf springs 26. The swivel elements 4 are supported on the support elements 18 by the bolts 22*a* and by the leaf springs 26. The leaf springs 26 are configured to be so rigid that they counteract a sliding movement of the bolts 22*a* along the leaf springs 26, which movement is caused by the force of the tensioning mechanism 14. In other words, the force introduced into the swivel elements 4 by the tensioning mechanism 14 or the moment, resulting therefrom, about the swivel axes 16 is insufficient to displace the leaf springs 26 towards the swivel axes 16 with the aid of the bolts 22*a* and thus is insufficient to move the swivel elements 4 out of the open position into the closed position. Consequently, the swivel elements 4 are held in a stable manner in the open position.

To move the swivel elements 4 out of the open position into the closed position while the holding devices 20*a* are simultaneously in switch position B, an impulse or actuating power has to be introduced in the region of the actuating portions 10. This can be performed by a machine (not shown), for example, which engages between the actuating portions 10 and spreads these portions 10 apart. The actuating power applied to the actuating portions 10 supports the force of the tensioning mechanism 14. The bolts 22*a* displace the leaf springs 26 towards the swivel axes 16.

After passing through an unstable intermediate position, the swivel elements 4 fall back into the closed position. The unstable intermediate position is the swivel position of the swivel elements 4 in which the forces and moments about the swivel axes 14, which are introduced into the swivel elements by the tensioning mechanism 14 and the holding devices 20 cancel each other out. During any change of the swivel elements 4 from the open position to the closed position or vice versa, the respective leaf spring 26 has to be displaced towards the support element 18 with the bolt 22*a* by an externally introduced actuating power to pass the unstable intermediate position of the swivel elements 4 towards the desired position of the swivel elements 4.

Figure 4A:
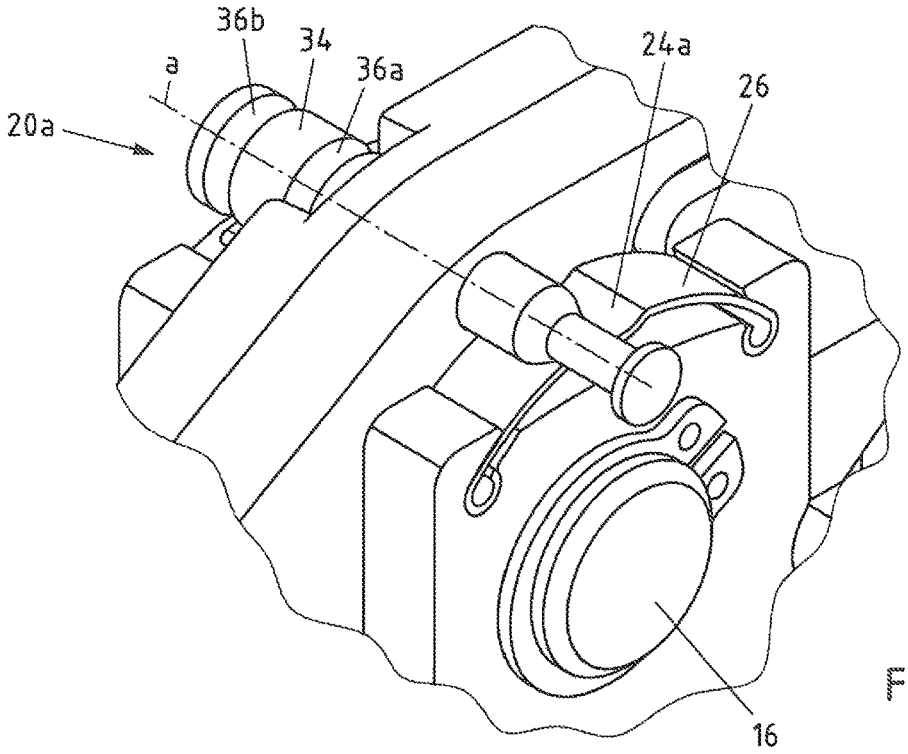
FIGS. 4*a*, 4*b* are two perspective views of enlarged details of the pressing tool in the closed position, with the holding devices in the second switch position.
Figure 4B:
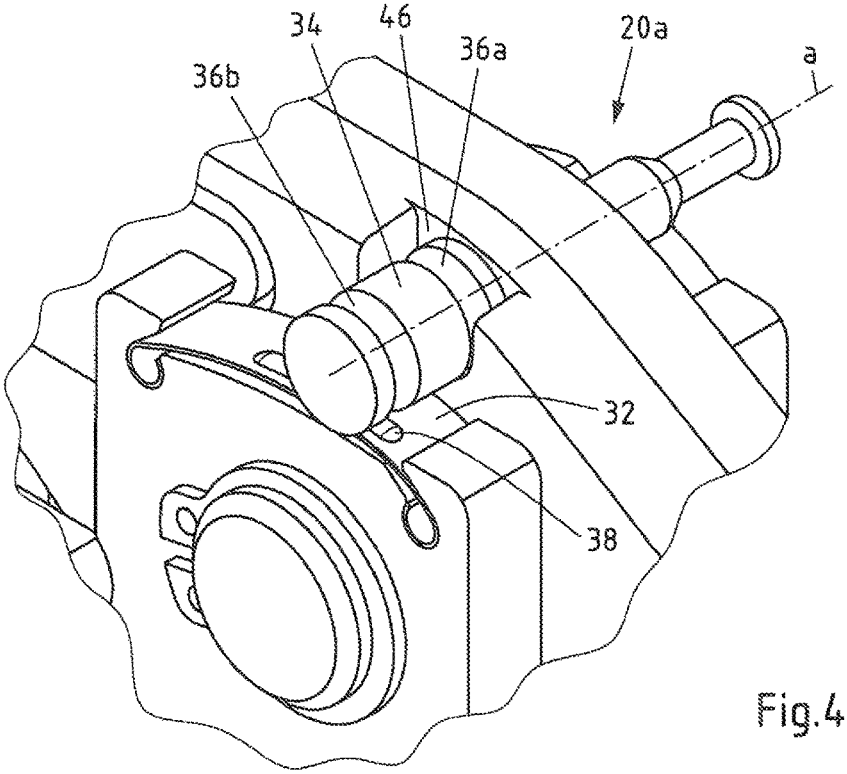

During the movement of the swivel elements 4 out of the open position into the closed position, the bolt 22*a* is guided along the guide path 38 of the guide rail 32. Therefore, as the swivel elements 4 are changed from the open position to the closed position or vice versa. The bolt 22*a* remains in its engaged position (FIG. 4). The interaction between the guide rail 32 and the grooves 36*a*, 36*b* therefore also holds the bolt 22*a* in the respectively set switch position A or B for the subsequent pressing procedures. In the case described here, the bistable behaviour of the pressing tool 2 is maintained until the user actively moves the bolt 22*a* again out of switch position B into switch position A.

Figure 5:
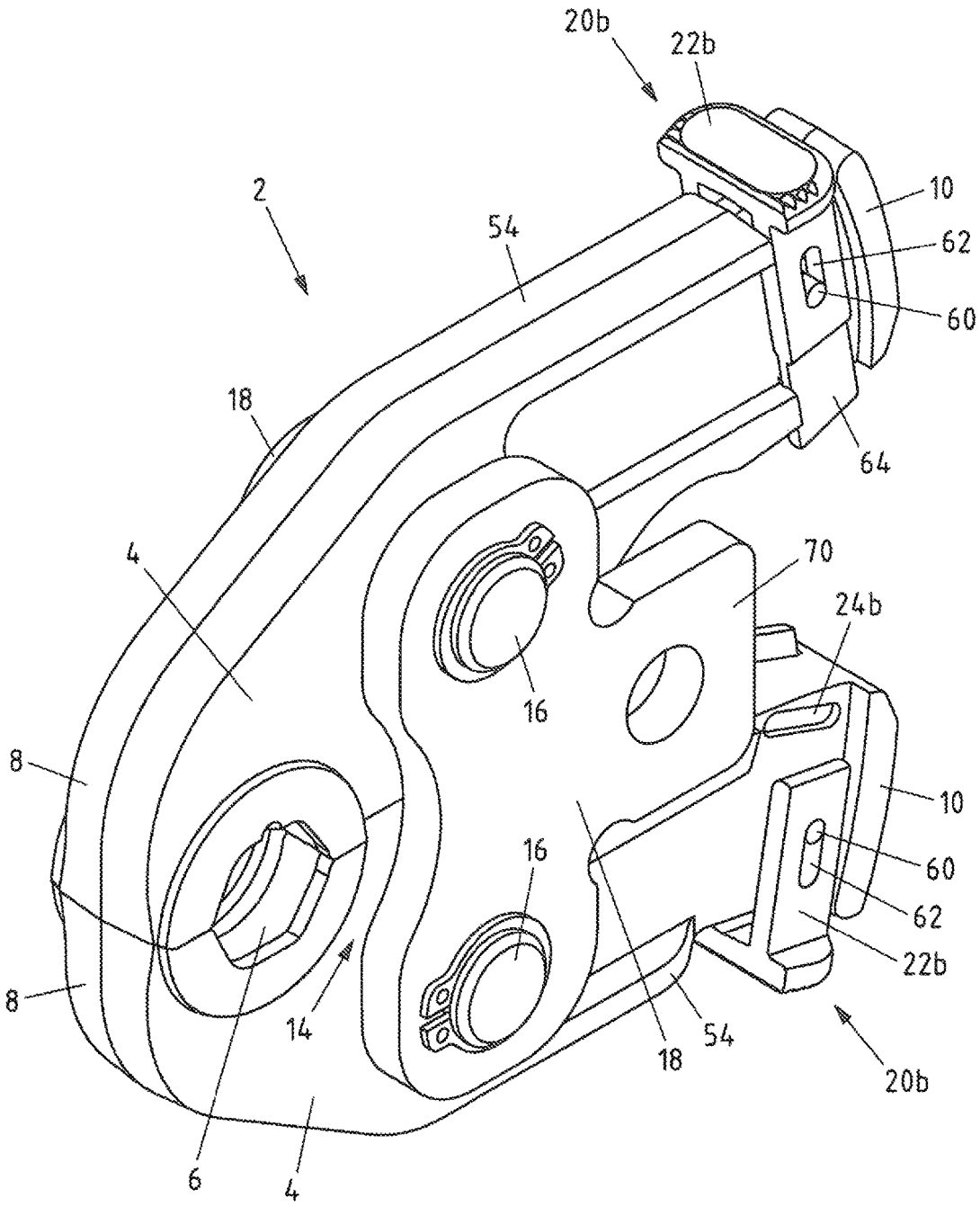
FIG. 5 is a perspective view of a second embodiment of a pressing tool according to the invention in the closed position.
Figure 6A:
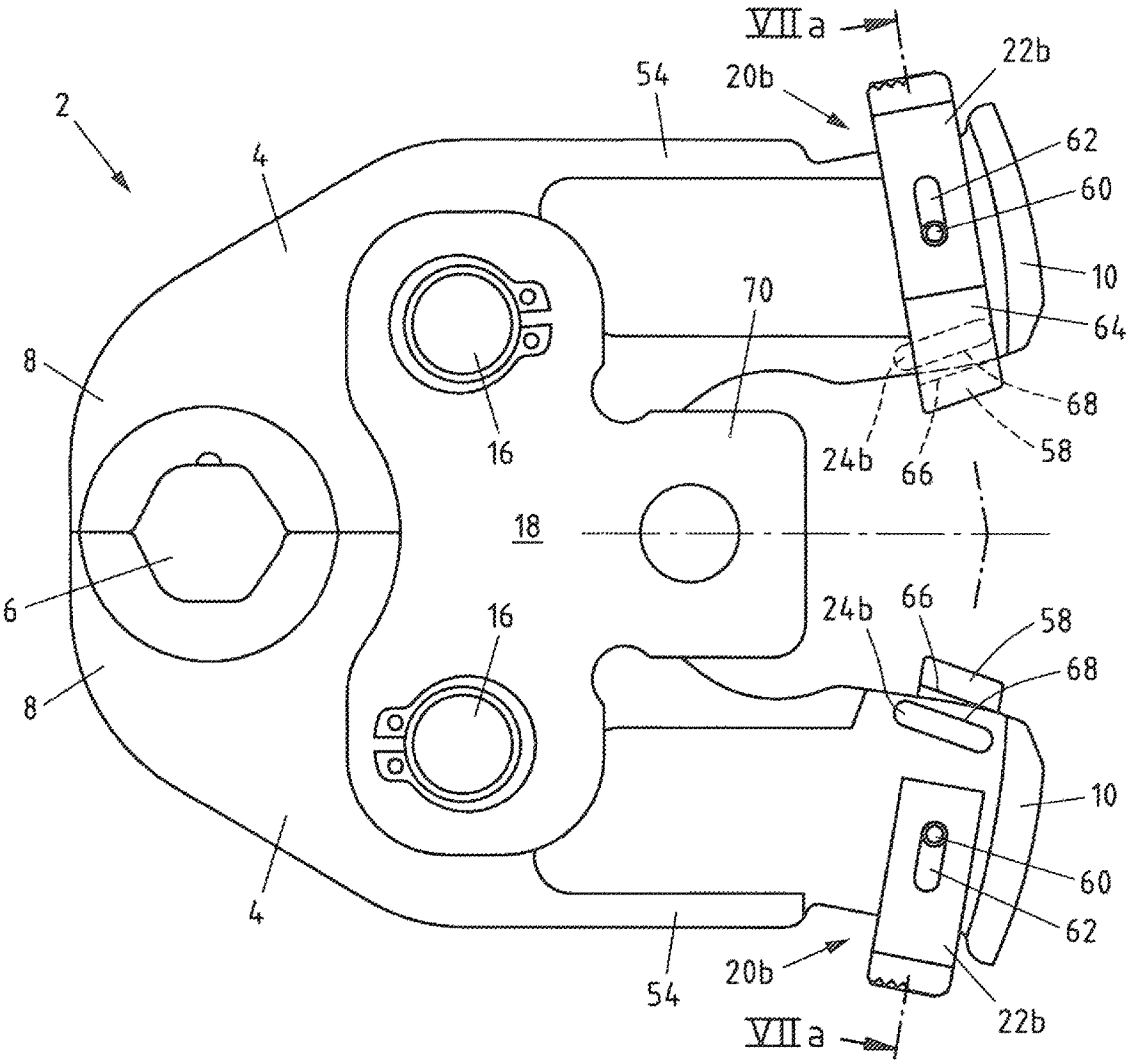
FIG. 6*a* is a side view of the pressing tool from FIG. 5 in the closed position, with holding devices in a first switch position.

FIGS. 5 and 6*a* are a perspective view and a side view of a further embodiment of a pressing tool 2 according to the invention in the closed position, with holding devices 20*b* in a first switch position A, and in the following, the same reference numerals are assigned to the same elements with reference to the first embodiment.

The pressing tool 2 has two swivel elements 4 for pressing a pipe (not shown) and a fitting (not shown), with a receiving region 6, formed between the swivel elements 4, for receiving the pipe and the fitting. The swivel elements 4 are mounted rotatably about the swivel axes 16. The swivel axes 16 are supported by the support elements 18. The swivel elements 4 can be swivelled towards one another about the swivel axes 18 to press the pipe and fitting. A tensioning mechanism 14 arranged between the swivel elements 4 and the support elements 18 is used to pretension the pressing tool 2 towards the closed position.

The pressing tool 2 has two holding devices 20*b* for holding the swivel elements 4 in the open position against the pretensioning force generated by the tensioning mechanism 14. The holding devices 20*b* are switchable, the holding device 20*b* and the tensioning mechanism 14 forming a switchable, bistable tensioning mechanism. The holding devices 20*a* have a respective locking element 22*b* and a locking recess 24*b*, the locking recess 24*b* being formed as a locking groove 24*b*. The locking element 22*b* is a sliding element 22*b* which is guided such that it is slidably movable on one swivel element 4.

Figure 6B:
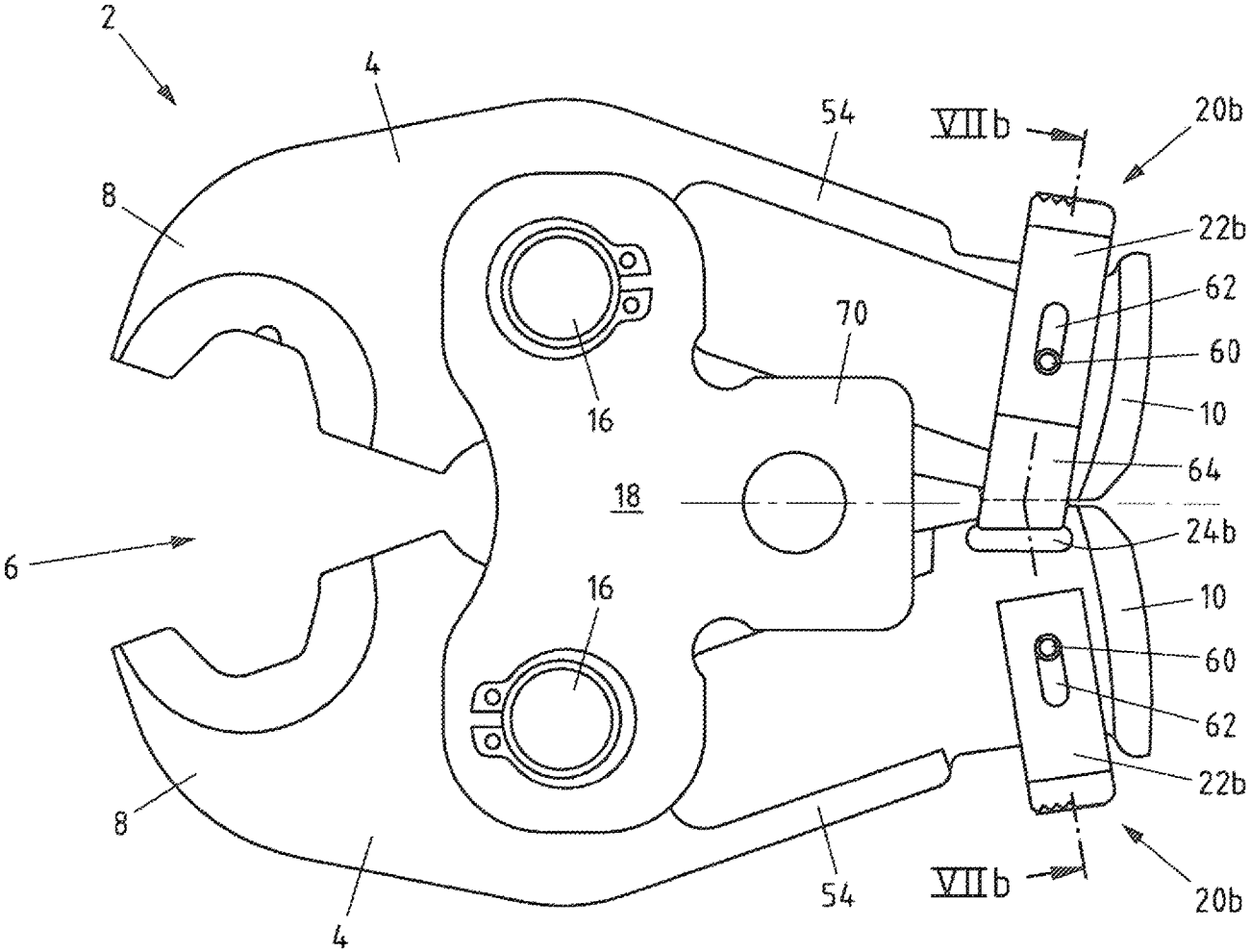
FIG. 6*b* is a side view of the pressing tool from FIG. 5 in an open position, with the holding devices in the first switch position.
Figure 6C:
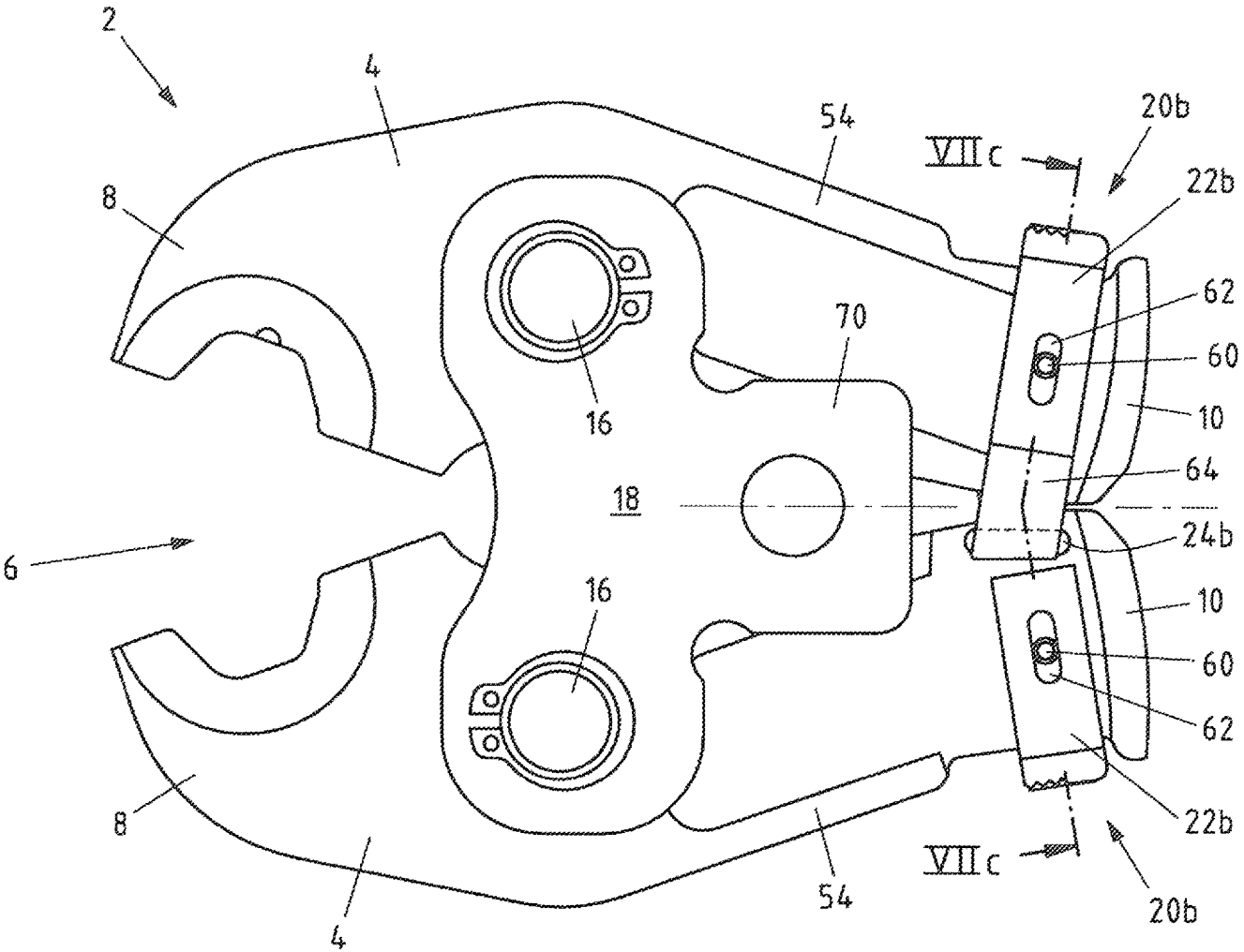
FIG. 6*c* shows the pressing tool from FIG. 5 in an open position, with the holding devices in a second switch position.
Figure 7C:
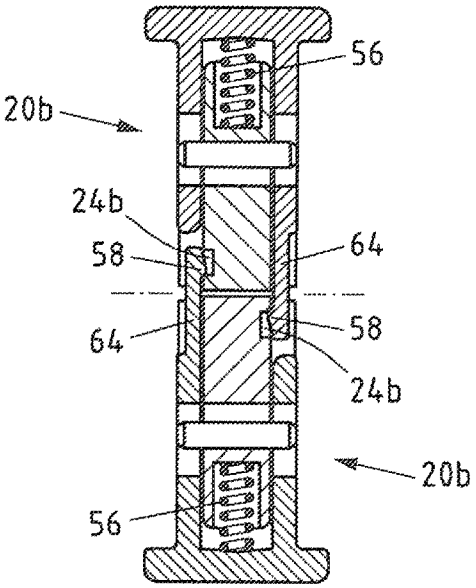
FIG. 7*c* is a sectional view of the holding devices along line VIIc-VIIc from FIG. 6*c;*
Figure 7B:
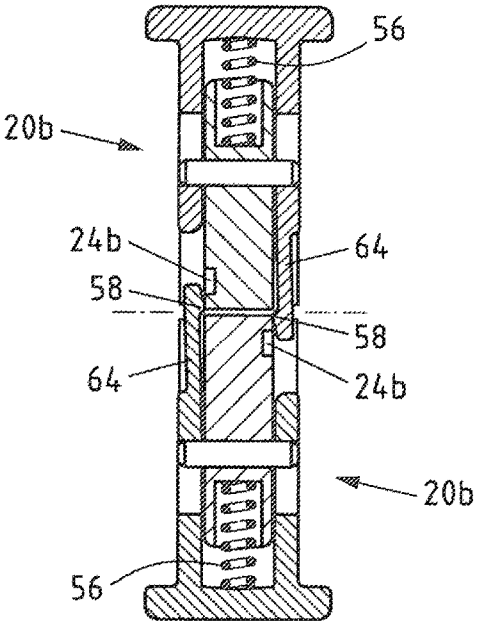
FIG. 7*b* is a sectional view of the holding devices along line VIIb-VIIb from FIG. 6*b;*
Figure 7A:
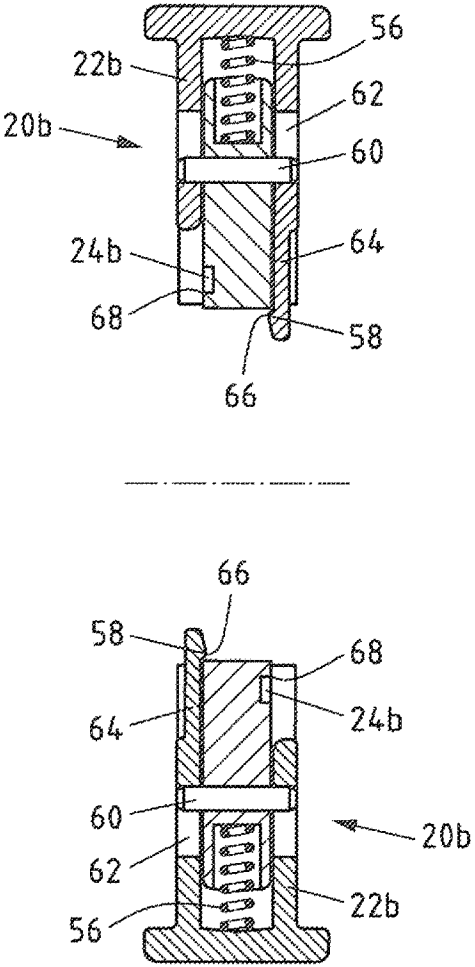
FIG. 7*a* is a sectional view of the holding devices along line VIIa-VIIa from FIG. 6*a;*

In order to more clearly understand the following information concerning the mode of operation of the holding device 20*b*, FIG. 7 shows respective sectional views of the switch positions described with reference to FIG. 6. FIG. 7*a* is a sectional view of the holding devices along line VIIa-VIIa from FIG. 6*a*. FIG. 7*b* is a sectional view of the holding devices along line VIIb-VIIb from FIG. 6*b*. FIG. 7*c* is a sectional view of the holding devices along line VIIc-VIIc from FIG. 6*c*.

FIG. 6*b* shows the pressing tool 2 from FIG. 6*a* in an open position, with the holding devices 20*b* in the first switch position A. In the open position of the swivel elements 4 according to FIG. 2*b*, the receiving region 6 is wider than in the closed position of the swivel elements 4 from FIG. 2*a*.

In the open position of the swivel elements 4 shown in FIG. 6*b*, the tensioning mechanism 14 is released because the holding devices 20*b* are in the first switch position A. In this state, the holding devices 20*b* do not work against the tensioning mechanism 14.

To transfer the pressing tool 2 from the closed position of the swivel elements 4 shown in FIG. 6*a* into the open position of the swivel elements 4 shown in FIG. 6*b*, the user presses the swivel elements 4 together in the region of the actuating portions 10 without actuating the holding devices 20*b*. For this purpose, the user grasps and actuates the actuating portions 10 at their respective portions 54 mounted upstream of the holding devices 20*b* in the direction of the receiving region 6. In this case, the sliding elements 22*b* remain in the starting position shown in FIG. 6*a* relative to the swivel elements 4. In the open position of the swivel elements 4 shown in FIG. 6*b*, the sliding elements 22*b* do not engage in the locking grooves 24*b* in the swivel elements 4. As shown in the sectional views according to FIGS. 7*a* and 7*b*, the sliding elements 22*b* are held in the first switch position A, pretensioned by a helical compression spring 56.

As long as the user actively holds the pressing tool 2 in the open position of the swivel elements 4 shown in FIG. 6*b*, with the holding devices 20*b* in the first switch position, the swivel elements 4 remain in the open position. If the user does not act on the pressing tool 2, the swivel elements 4 are swivelled back into the closed position shown in FIG. 6*a* due to the pretensioning force provided by the tensioning mechanism 14.

FIG. 6*c* shows the pressing tool from FIG. 6*a* in an open position, with the holding devices 20*b* in the second switch position B. In the second switch position B, the holding devices 20 counteract the tensioning mechanism 14. The locking projections 58 of the sliding elements 22*b* engage in the locking grooves 24*b*. The respective sliding element 22*b* can be moved between the first switch position A and the second switch position B and is guided bilaterally on the associated swivel element 4 by a mandrel 60 in a groove 62.

The holding devices 20*b* which have moved into switch position B hold the swivel elements 4 of the pressing tool 2 in the open position. To transfer the pressing tool 2 from the closed position shown in FIG. 6*a* into the open position shown in FIG. 6*c*, while simultaneously switching the holding devices 20*b*, the user actuates the actuating portions 10, from the position shown in FIG. 6*a*, in the region of the holding devices 20*b*. Therefore, the user presses the actuating portions 10 together via the two sliding elements 22*b*. In addition to a swivelling movement of the swivel elements 4 into the open position, the sliding elements 22*b* are simultaneously moved against the helical compression springs 56 towards the locking grooves 24*b* respectively provided in the opposite swivel elements 4.

The holding devices 20*b* can be transferred in exactly the same way from switch position A shown in FIG. 6*b* into switch position B in that the sliding elements 22*b* are moved towards one another so that the locking projections 58 engage in the locking grooves 24*b*.

In switch position B of the holding devices 20*b* shown in FIG. 6*c*, the pressing tool 2 is braced resiliently in the open position of the swivel elements 4. In this respect, the flexural spring portions 64 of the sliding elements 22*b*, supporting the locking projections 58 and resting on the swivel elements 4 counteract a sliding movement of the bevels 66 of the locking projections 42 on the edges 68 of the locking grooves 24*b*. Therefore, the swivel elements 4 are held in a stable manner in the open position.

The swivel elements 4 can be transferred from the switch position shown in FIG. 6*c* into the closed position shown in FIG. 6*a* in that the actuating portions 10 are spread apart by means of a machine (not shown). For this purpose, the machine is coupled in a known manner to the coupling portions 70 of the support elements 18. The machine presses the actuating portions 10 apart, the bevels 66 sliding on the edges 68, and the holding forces of the flexural spring portions 64 are overcome thereby. As soon as the locking projections 58 no longer engage with the locking grooves 24*b*, the swivel elements 4 swivel back into the closed position due to the pretensioning force of the tensioning mechanism 14. For their part, the sliding elements 22*b* are moved back into the disengaged starting position shown in FIG. 6*a* due to the helical compression springs 56 and they are held, pretensioned, in this position by the helical compression springs 56.

FIG. 8 shows a third embodiment of a pressing tool 2 according to the invention, and in the following, the same reference numerals are assigned to the same elements with reference to the above embodiments.

Figure 8A:
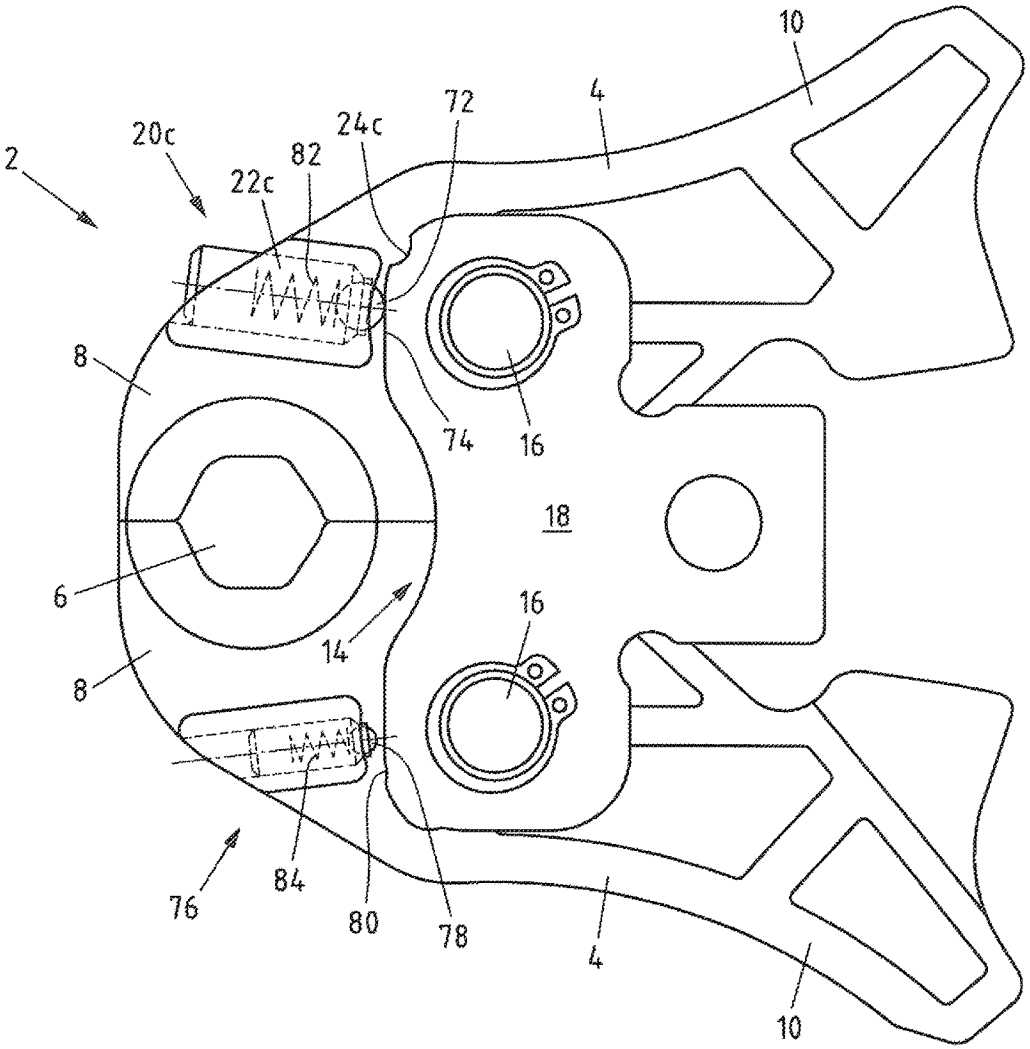
FIG. 8*a* is a side view of a third embodiment of a pressing tool according to the invention in the closed position.

FIG. 8*a* is a side view of the pressing tool 2 in the closed position. The pressing tool 2 has a holding device 20*c* formed by a pressure piece 22*c* and a depression 24*c*. The pressure piece 22*c* has a locking ball 72 which is resiliently pretensioned against a guide surface 74 formed on the support element 18. The pressure piece 22*c* is attached to the swivel element 4 and the depression 24*c* is provided in the support element 18 supporting the swivel axes 16. The guide surface 74 merges smoothly into the depression 24*c*. The pressure piece 22*c* has an external thread and is screwed into the swivel element 4.

Provided on the swivel element 4 opposite the pressure piece 22*c* is a second pressure piece 76 which counteracts a swivelling movement of the swivel elements 4 out of the closed position into the open position in a swivel range, the open position in particular being part of this swivel range. The pressure piece 76 has a locking ball 78 which is configured to interact with a locking recess 80. The locking recess 80 formed as a depression is flat-shaped compared to the depression 24*c*.

In the following, the actuation procedure of the pressing tool 2 will be described according to the third embodiment with reference to FIGS. 8*a* to 8*c*.

In the closed position of the swivel elements 4 shown in FIG. 8*a*, the locking ball 72 rests in a resiliently pretensioned manner against the guide surface 74. Therefore, in the position shown in FIG. 8*a*, the pressure piece 22*c* is in a tensioned state. The locking ball 78 of the second pressure piece 76 is at a distance from the support element 18 and from the locking recess 80 formed therein. Pressure piece 76 is in a relaxed state. The swivel elements 4 are held in the closed position, pretensioned by the tensioning mechanism 14.

In order to open the receiving region 6 to introduce a pipe and a fitting (not shown), the swivel elements 4 are pressed against one another in the region of the actuating portions 10 in order to swivel the swivel elements 4 about their respectively associated swivel axis 16 against the tensioning force of the tensioning mechanism 14.

Figure 8B:
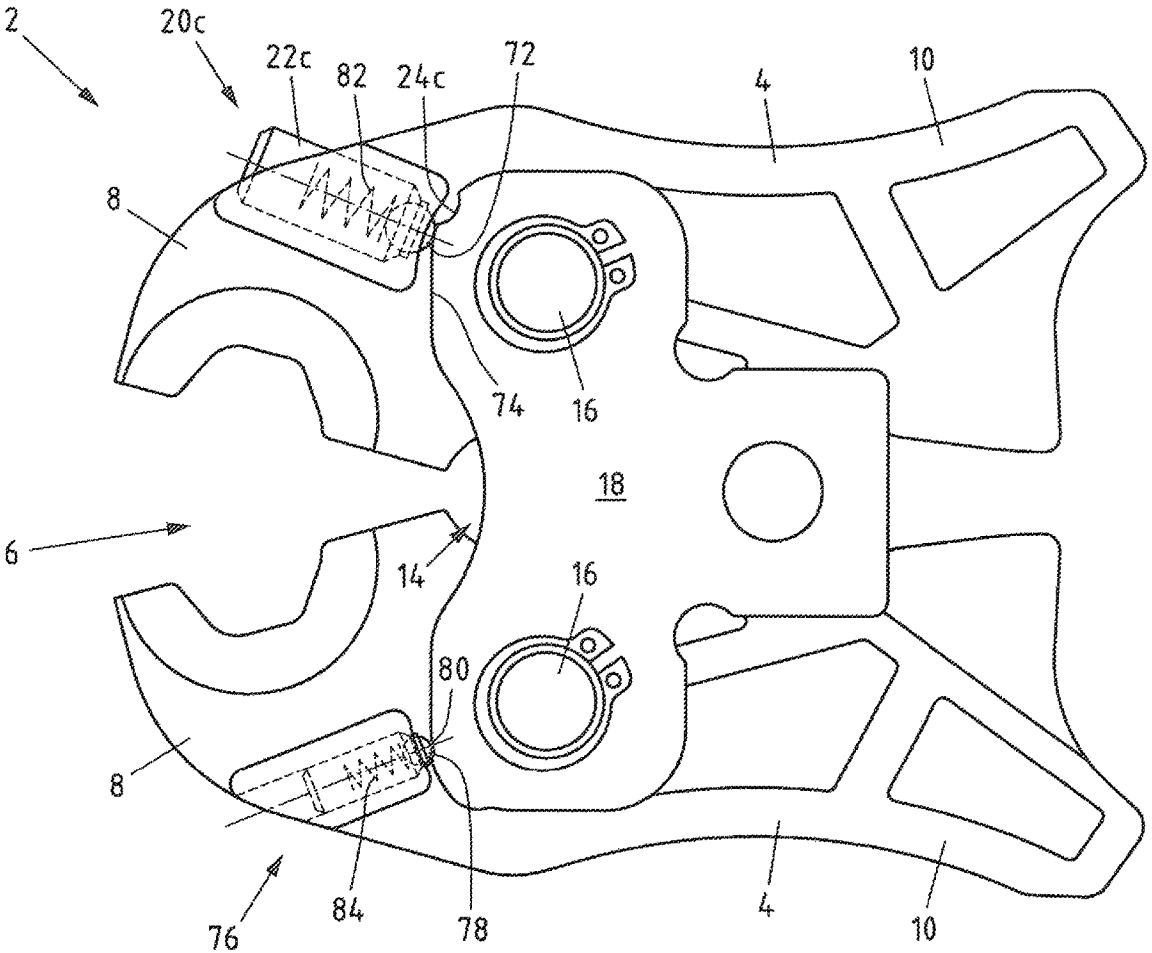
FIG. 8*b* is a side view of the pressing tool from FIG. 8*a* in an open position.

FIG. 8*b* shows the swivel elements 4 in an open position. In the swivel position of the swivel elements 4 shown in FIG. 8*b*, the pressure piece 22*c* is in the first switch position A. As in the closed position of the swivel elements 4 according to FIG. 8*a*, the locking ball 72 rests against the guide surface 74, remote from the swivel axis 16, of the support element 18. In switch position A, the pressure piece 22*c* does not substantially counteract a swivelling back movement of the swivel elements 4 into the closed position caused by the tensioning mechanism 14, because the smooth shape of the guide surface 74 which does not encompass the locking ball 72 promotes a rolling or sliding movement of the locking ball 72 along the guide surface 74.

The swivelling movement of the swivel elements 4 moves the locking ball 78 of the second pressure piece 76 according to FIG. 8*b* into the locking recess 80, so that locking recess 80 at least partly encompasses the locking ball 78. However, the pressure piece 76 is still in a relaxed state, as it is in FIG. 8*a*.

In the swivel position of the swivel elements 4 shown in FIG. 8*b*, the receiving region 6 is already so wide open that the pipe cross sections and fittings (not shown), provided to be pressed by the illustrated pressing tool 2, can be introduced into the receiving region 6.

Figure 8C:
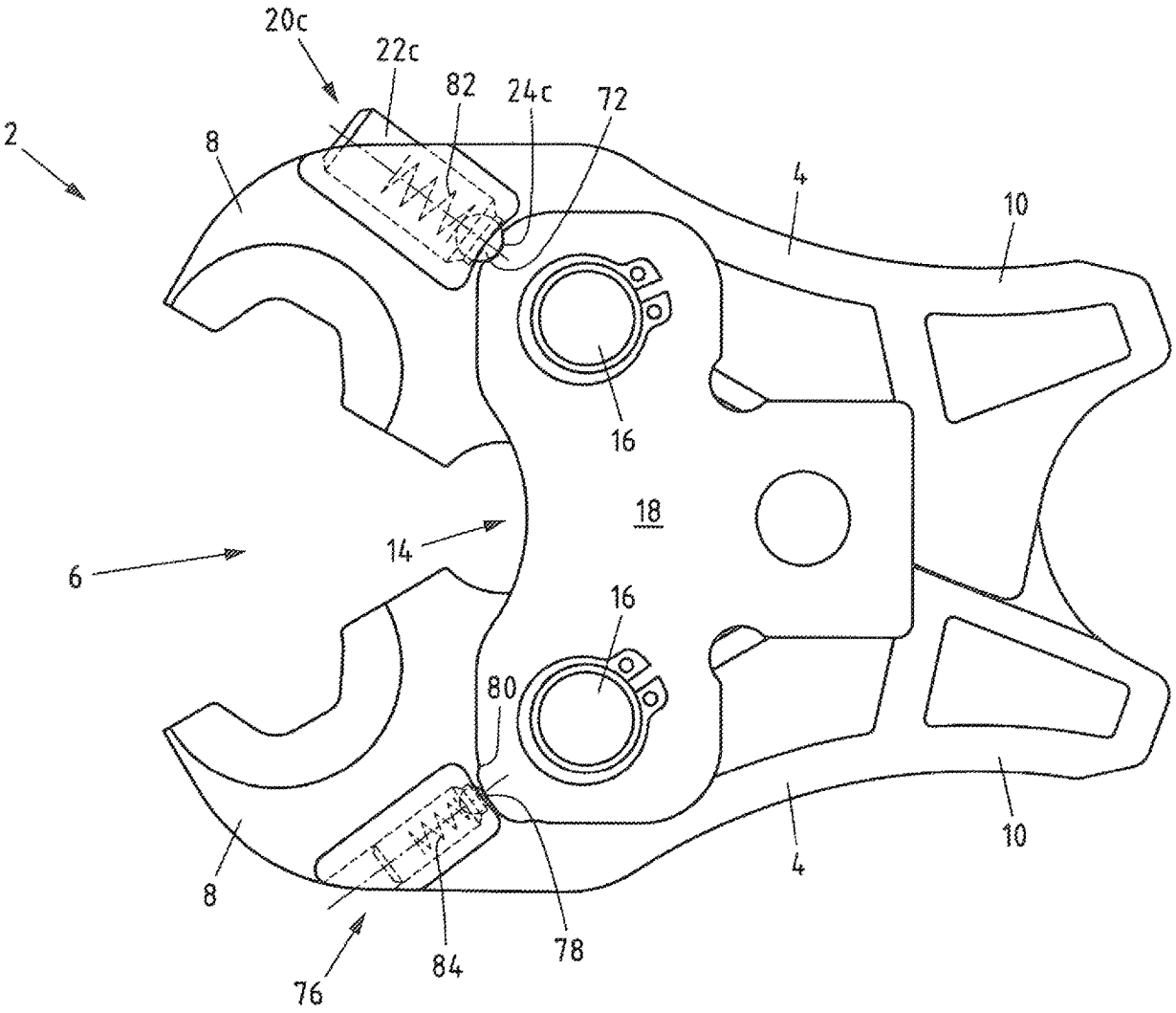
FIG. 8*c* is a side view of the pressing tool from FIG. 8*a* in an open position.

To fix the swivel elements 4 in the open position, the swivel elements 4 can be swivelled beyond the swivel position shown in FIG. 8*b*, as shown in FIG. 8*c*. In this swivel position of the swivel elements 4, the pressure piece

22*c* occupies the second switch position B, the locking ball 72 sitting in the depression 24*c*. The locking ball 72 is engaged in the depression 24*c*, so that the pressure piece 22*c* is in a relaxed state. Furthermore, according to further embodiments of a pressing tool according to the invention, the locking ball can also be held in the depression, braced by the spring provided in the pressure piece.

The interaction of the pressure piece 22*c* with the depression 24*c* prevents the swivel elements 4 from swivelling back into the closed position by the tensioning mechanism 14. In other words, the force introduced into the swivel elements 4 about the swivel axes 16 by the tensioning mechanism 14 is insufficient to displace the locking ball 72 out of the depression 24*c* against the spring 82 of the pressure piece 22*c* or to move it out of the depression 24*c* by sliding.

To move the swivel elements 4 back into the closed position shown in FIG. 8*a*, it is therefore necessary to spread the swivel elements 4 apart in the region of the actuating portions 10 by means of an additional force to overcome the clamping force of the holding device 20*c*. A force of this type can be provided, for example, by a machine, as already stated above with reference to the further embodiments.

When the swivel elements 4 are swivelled out of the swivel position shown in FIG. 8*b* into the swivel position shown in FIG. 8*c*, the second pressure piece 76 forms an additional resistance which counteracts a swivelling movement of the swivel elements 4. Starting from the position shown in FIG. 8*b*, the locking ball 80 of the second pressure piece 76 has to be displaced out of the locking recess 80 against the spring 84 of the pressure piece 76, so that the pressure piece 76 is tensioned in the swivel position shown in FIG. 8*c* and abuts against the support element 18.

In this way, the pressure piece 76 forms a defined pressure point which, during swivelling of the swivel elements 4, indicates to the user the swivel range in which the transition is taking place of the first pressure piece 22*c* or of the holding device 20*c* out of the first switch position A into the second switch position B.

In order to allow a swivelling movement of the swivel elements 4 into the position shown in FIG. 8*c* and at the same time to keep the distance of the actuating portions 10 as short as possible in the closed state of the swivel elements 4, the actuating portions 10 of the swivel elements 4 overlap in the position shown in FIG. 8*c*. Due to the overlapping actuating portions 10, a wider swivel range of the swivel elements 4 is provided compared to the embodiments described above. It is thereby also ensured that an opening width of the receiving region 6 which exceeds that which is usual for introducing the components to be pressed can be achieved in order to actuate the holding device 20*c*.

Figure 9:
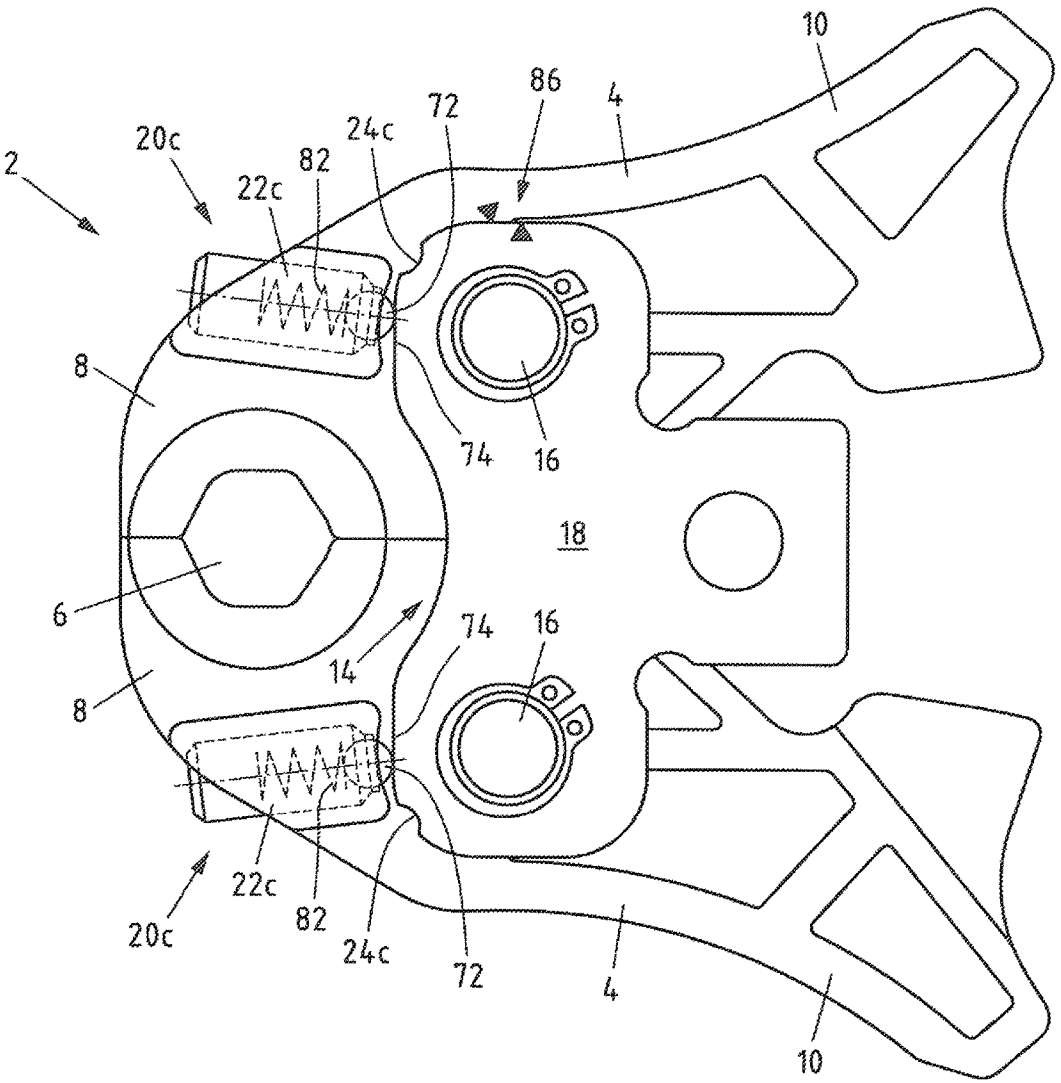
FIG. 9 is a side view of a fourth embodiment of a pressing tool according to the invention in a closed position.

FIG. 9 is a side view of a fourth embodiment of a pressing tool 2 according to the invention in a closed position. The embodiment shown in FIG. 9 differs from the embodiment shown in FIG. 8 only in that the second pressure piece 76 present in FIG. 8 has been replaced by a second holding device 20*c* according to the invention. In the embodiment shown in FIG. 9, markings 86 which are provided on the support element 18 and on the swivel element 4 indicate to the user the swivel position in which the transition is taking place of the holding devices 20*c* from the first switch position A into the second switch position B. If the markings 86 are positioned one directly above the other, the swivel elements 4 of the pressing tool 2 are in a swivel position comparable to FIG. 8*b*, the holding devices 20*c* being in the first switch position A.

According to further embodiments of the pressing tool according to the invention, it is also possible to provide only a single holding device to fix the swivel elements in an open position. In this respect, a transmission which couples the movement of the swivel elements can preferably be provided between the swivel elements, so that the swivelling or fixing of one swivel element causes the respective other swivel element to be swivelled or fixed.

The invention claimed is:

1. A pressing tool for joining a pipe and a fitting, comprising:

two swivel elements for pressing the pipe and the fitting, a receiving region, formed between the swivel elements, for receiving the pipe and the fitting, at least one swivel axis for rotatably mounting the swivel elements, and a tensioning mechanism for pretensioning the pressing tool, wherein the swivel elements can be swivelled relative to one another about the at least one swivel axis to press the pipe and the fitting, wherein in a first, closed position, the receiving region is narrower than in a second, open position, of the swivel elements, wherein the swivel elements are pretensioned toward the closed position by the tensioning mechanism, and wherein at least one holding device is provided for holding the swivel elements in the open position against a pretensioning force generated by the tensioning mechanism, wherein the at least one holding device is switchable between a first operating mode in which the tensioning mechanism, but not the at least one holding device, acts on the swivel elements and a second operating mode in which the at least one holding device and the tensioning mechanism form a switchable, bistable tensioning mechanism wherein the at least one holding device has in the open position of the swivel elements a first switch position in which the tensioning mechanism is released, wherein the at least one holding device has in the open position of the swivel elements a second switch position in which the at least one holding device works against the tensioning mechanism, wherein the at least one holding device is braced resiliently in the second switch position, wherein the at least one holding device has at least one locking element and at least one locking recess, the at least one locking element interacting with the at least one locking recess in the second switch position, and wherein the at least one locking element and the at least one locking recess of the at least one holding device are provided on two different components, these components being swivellable about the at least one swivel axis relative to one another and at least one of the components being one of the swivel elements.

2. A pressing tool for joining a pipe and a fitting, comprising:

two swivel elements for pressing the pipe and the fitting, a receiving region, formed between the swivel elements, for receiving the pipe and the fitting, at least one swivel axis for rotatably mounting the swivel elements, and a tensioning mechanism for pretensioning the pressing tool, wherein the swivel elements can be swivelled relative to one another about the at least one swivel axis to press the pipe and the fitting, wherein in a first, closed position, the receiving region is narrower than in a second, open position, of the swivel elements, wherein the swivel elements are pretensioned toward the closed position by the tensioning mechanism, and wherein at least one holding device is provided for holding the swivel elements in the open position against a pretensioning force generated by the tensioning mechanism, wherein the at least one holding device is switchable between a first operating mode in which the tensioning mechanism, but not the at least one holding device, acts on the swivel elements and a second operating mode in which the at least one holding device and the tensioning mechanism form a switchable, bistable tensioning mechanism, wherein the at least one holding device has in the open position of the swivel elements a first switch position in which the tensioning mechanism is released, wherein the at least one holding device has in the open position of the swivel elements a second switch position in which the at least one holding device works against the tensioning mechanism, wherein the at least one holding device is braced resiliently in the second switch position, wherein the at least one holding device has at least one locking element and at least one locking recess, the at least one locking element interacting with the at least one locking recess in the second switch position, and wherein the at least one locking element is a substantially cylindrical bolt and the locking recess is a depression formed in a leaf spring.

3. The pressing tool according to claim 2, wherein the bolt can be displaced in an axial direction between the first switch position and the second switch position, the bolt being at a distance from the leaf spring in the first switch position and resting peripherally on the leaf spring in the second switch position.

4. The pressing tool according to claim 2, wherein the bolt rests on a guide rail which holds the bolt in the respective axial switch position.

5. The pressing tool according to claim 4, wherein the guide rail is a leaf spring.

6. The pressing tool according to claim 4, wherein the bolt has on a portion associated with the guide rail two mutually spaced apart, peripherally running grooves which interact with a guide path of the guide rail in the respective switch position.

7. A pressing tool for joining a pipe and a fitting, comprising:

two swivel elements for pressing the pipe and the fitting, a receiving region, formed between the swivel elements, for receiving the pipe and the fitting, at least one swivel axis for rotatably mounting the swivel elements, and a tensioning mechanism for pretensioning the pressing tool, wherein the swivel elements can be swivelled relative to one another about the at least one swivel axis to press the pipe and the fitting, wherein in a first, closed position, the receiving region is narrower than in a second, open position, of the swivel elements, wherein the swivel elements are pretensioned toward the closed position by the tensioning mechanism, and wherein at least one holding device is provided for holding the swivel elements in the open position against a pretensioning force generated by the tensioning mechanism, wherein the at least one holding device is switchable between a first operating mode in which the tensioning mechanism, but not the at least one holding device, acts on the swivel elements and a second operating mode in which the at least one holding device and the tensioning mechanism form a switchable, bistable tensioning mechanism, wherein the at least one holding device has in the open position of the swivel elements a first switch position in which the tensioning mechanism is released, wherein the at least one holding device has in the open position of the swivel elements a second switch position in which the at least one holding device works against the tensioning mechanism, wherein the at least one holding device is braced resiliently in the second switch position, wherein the at least one holding device has at least one locking element and at least one locking recess, the at least one locking element interacting with the at least one locking recess in the second switch position, and wherein the at least one locking element has a sliding element which is slidably guided on one of the swivel elements, the sliding element being displaceable between the first switch position and the second switch position, and the at least one locking recess being formed in the other one of the swivel elements.

8. The pressing tool according to claim 7, wherein the sliding element is held pretensioned in the first switch position.

9. The pressing tool according to claim 7, wherein the swivel elements are provided with two sliding elements and wherein the at least one locking element includes two locking recesses.

10. A pressing tool for joining a pipe and a fitting, comprising:

two swivel elements for pressing the pipe and the fitting, a receiving region, formed between the swivel elements, for receiving the pipe and the fitting, at least one swivel axis for rotatably mounting the swivel elements, and a tensioning mechanism for pretensioning the pressing tool, wherein the swivel elements can be swivelled relative to one another about the at least one swivel axis to press the pipe and the fitting, wherein in a first, closed position, the receiving region is narrower than in a second, open position, of the swivel elements, wherein the swivel elements are pretensioned toward the closed position by the tensioning mechanism, and wherein at least one holding device is provided for holding the swivel elements in the open position against a pretensioning force generated by the tensioning mechanism, wherein the at least one holding device is switchable between a first operating mode in which the tensioning mechanism, but not the at least one holding device, acts on the swivel elements and a second operating mode in which the at least one holding device and the tensioning mechanism form a switchable, bistable tensioning mechanism, wherein the at least one holding device has in the open position of the swivel elements a first switch position in which the tensioning mechanism is released, wherein the at least one holding device has in the open position of the swivel elements a second switch position in which the at least one holding device works against the tensioning mechanism, wherein the at least one holding device is braced resiliently in the second switch position, wherein the at least one holding device has at least one locking element and at least one locking recess, the at least one locking element interacting with the at least one locking recess in the second switch position, and wherein the at least one locking element is a pressure piece, the pressure piece having in particular a locking ball which is resiliently pretensioned in the first switch position and sits in a locking recess formed as a depression in the second switch position.

11. The pressing tool according to claim 10, wherein the pressure piece is attached to one of the swivel elements and the at least one locking recess is provided in a support element supporting the at least one swivel axis.

12. The pressing tool according to claim 11, wherein a second pressure piece is provided which counteracts a swivelling movement of the swivel elements out of the closed position into the open position in a swivel range.

* * * * *